US007299749B2

(12) United States Patent
Tomita et al.

(10) Patent No.: US 7,299,749 B2
(45) Date of Patent: Nov. 27, 2007

(54) LITHOGRAPHIC PRINTING PLATE SUPPORT AND PRODUCTION METHOD THEREOF

(75) Inventors: Tadabumi Tomita, Shizuoka (JP); Yoshinori Hotta, Shizuoka (JP)

(73) Assignee: Fujifilm Corporation, Tokyo (JP)

( * ) Notice: Subject to any disclaimer, the term of this patent is extended or adjusted under 35 U.S.C. 154(b) by 142 days.

(21) Appl. No.: 10/771,424

(22) Filed: Feb. 5, 2004

(65) Prior Publication Data

US 2004/0154488 A1 Aug. 12, 2004

(30) Foreign Application Priority Data

Feb. 10, 2003 (JP) ..... P2003-032353
Mar. 20, 2003 (JP) ..... P2003-078684
Mar. 20, 2003 (JP) ..... P2003-078863

(51) Int. Cl.
*B41N 1/04* (2006.01)

(52) U.S. Cl. ..... 101/458; 101/454; 430/302

(58) Field of Classification Search ..... None
See application file for complete search history.

(56) References Cited

U.S. PATENT DOCUMENTS 3,511,661 A * 5/1970 Rauner et al. ..... 430/278.1
3,516,911 A * 6/1970 Hopps, Jr. ..... 205/53
4,082,902 A * 4/1978 Suzuki et al. ..... 428/457
4,090,880 A * 5/1978 Chu et al. ..... 430/304
4,427,765 A * 1/1984 Mohr et al. ..... 430/525
4,448,647 A * 5/1984 Gillich et al. ..... 205/50
4,482,444 A * 11/1984 Frass et al. ..... 430/278.1
4,542,089 A 9/1985 Cadwell et al.
5,109,771 A * 5/1992 Lewis et al. ..... 101/453
5,249,525 A 10/1993 Lewis et al.
5,743,188 A * 4/1998 Ghosh et al. ..... 101/467
6,520,088 B2 * 2/2003 Vosseler ..... 101/478
2001/0042469 A1 11/2001 Vosseler
2003/0024426 A1 * 2/2003 Kasai et al. ..... 101/453

FOREIGN PATENT DOCUMENTS

DE 198 14 877 A1 10/1998
DE 199 00 049 A1 7/1999
EP 1142708 A1 * 10/2001
EP 1 302 312 A2 4/2003
JP 2000-169758 A 6/2000
JP 2001-318458 A 11/2001
JP 2002-2133 A 1/2002

OTHER PUBLICATIONS

European Search Report dated Jun. 4, 2004.

* cited by examiner

*Primary Examiner*—Jill E. Culler
(74) *Attorney, Agent, or Firm*—Sughrue Mion Pllc

(57) ABSTRACT

A lithographic printing plate support comprising a substrate having thereon a porous layer comprising metal oxide particles bound by a compound containing a metal atom and a phosphorus atom.

8 Claims, 1 Drawing Sheet

LITHOGRAPHIC PRINTING PLATE SUPPORT AND PRODUCTION METHOD THEREOF

FIELD OF THE INVENTION

The present invention relates to a lithographic printing plate support and a production method thereof. More specifically, the present invention relates to a lithographic printing plate support which enables the plate-making by scan-exposure based on digital signals and ensures scratch resistance, excellent sensitivity, staining resistance, shiny property and press life all in a level equal to or higher than that of a lithographic printing plate support where an anodic oxide film is provided, and also relates to a production method thereof.

Furthermore, the present invention relates to a lithographic printing plate support which ensures reduction in the production cost in addition to the above-described properties, and a production method thereof.

BACKGROUND OF THE INVENTION

In the field of lithographic printing, a metal substrate is widely used as the substrate for a lithographic printing plate support used in a lithographic printing plate precursor for the production of a lithographic printing plate. In particular, aluminum is known to form an oxide film by supplying direct current using the aluminum as an anode in an acidic solution and this metal is advantageous in various points, that is, a treatment generally known as an alumite treatment can be applied and moreover, the metal is lightweight and inexpensive. When an alumite treatment is applied to the aluminum surface, alumina having high acid resistance or high hardness as compared with metal aluminum is formed as the oxide film and a large number of small holes called pores are regularly produced in the film structure to greatly increase the surface area according to BET method (gas adsorption method). Therefore, the alumite treatment is advantageous in that improvements such as improvement of hydrophilicity of a lithographic printing plate support and improvement of adhesive strength at the time of forming a coating film can be attained, and when a printing plate is produced, both excellent staining resistance (in the present invention, referred to as "difficult staining") and excellent press life can be obtained.

In recent years, a so-called heat-mode CTP lithographic printing plate precursor (hereinafter simply referred to as a "heat-mode lithographic printing plate precursor") is attracting attention, where an image can be formed by exposure with light in the region from near infrared to infrared ray, particularly, a printing plate can be produced directly from digital data of a computer or the like by recording an image while utilizing the heat generated upon light irradiation with a laser having light emission in that region.

In this lithographic printing plate precursor, the laser light irradiated for drawing an image is converted into heat by a light-to-heat conversion material or the like contained in the photosensitive layer and the heat generated is used for changing the solubility of the photosensitive layer in a developer or causing thermal decomposition or, due to abrupt heating, explosive expansion and removal (ablation) of the photosensitive layer. When aluminum is used as the support of the heat-mode lithographic printing plate precursor, high heat conductivity of the aluminum allows radiation of the generated heat toward the support side to result in the loss of the generated heat and this is one of causes for the reduction in the sensitivity of the lithographic printing plate precursor. In other words, when the heat insulating property on the surface of a lithographic printing plate support is enhanced and the radiation of heat generated in the photosensitive layer can be minimized, it is estimated that the sensitivity of a lithographic printing plate precursor can be elevated.

A technique of elevating the sensitivity by using an organic material having a low heat conductivity, such as PET, for the support has being studied. However, such materials are low in the hydrophilicity as compared with metal materials and absorb moisture during the printing to deteriorate the dimensional precision and therefore, these materials cannot be used at present for high-level printing such as color printing and high-precision printing.

Accordingly, alumina as the support for use in a heat-mode lithographic printing plate precursor is demanded to be improved in the low heat insulating property due to its high heat conductivity while maintaining easy applicability of various surface treatments and excellent properties such as hydrophilicity and dimensional precision stability of the aluminum.

In order to improve the low heat insulating property of the aluminum support, for example, a method of increasing the thickness of an anodic oxide film by utilizing the property such that the anodic oxide film formed on a lithographic printing plate support is by itself low in the heat conductivity, and a method of forming an anodic oxide film and then dipping the support in an aqueous alkali solution to enlarge the diameter of pores present in the film and thereby increase the porosity of the film have been proposed.

However, for increasing the thickness of the anodic oxide film, a large quantity of electricity is necessary at the time of forming the anodic oxide film and this gives rise to an increase in the cost. In the method of increasing the porosity of the film, the strength of the film decreases and therefore, when the film is scratched, an ink enters into the scratch to cause staining. That is, the method of providing an anodic oxide film has a problem in that both the film strength and the heat insulating property cannot be satisfied at the same time, more specifically, a sufficiently high film strength cannot be obtained and cost-up or staining is caused, though excellent heat insulating property may be obtained and the low sensitivity may be improved.

For example, Patent Document 1 (JP-A-2001-318458 (the term "JP-A" as used herein means an "unexamined published Japanese patent application")) describes a technique for enhancing the heat insulating property on the support surface and thereby elevating the sensitivity of the produced heat-mode lithographic printing plate, where an anodic oxide film with a predetermined porosity and having micropores with a predetermined diameter is formed by controlling the conditions for anodization of an aluminum plate and applying treatments such as a treatment for enlarging the pore diameter of micropores of the oxide film after the anodization step and a pore-sealing treatment.

Also, Patent Document 2 (JP-A-2002-2133) describes a heat-sensitive lithographic printing plate, where a hydrophilic layer containing hollow particles is provided between the support and a heat-sensitive layer and thereby, enhancement of the heat insulating property and in turn, elevation of the sensitivity can be attained.

However, these techniques of enhancing the heat insulating property of the support of a heat-sensitive lithographic printing plate have a problem in that in order to increase the thickness of the oxide film, an extra quantity of electricity is required or the process is complicated and this leads to the increase in the production cost.

As a film for taking the place of the anodic oxide film formed on a lithographic printing plate support, for example, a hydrophilic layer for a lithographic printing plate has been proposed, which comprises a hydrophilic layer containing alumina particles and in which the hydrophilic layer is treated with a solution containing a silicic acid (see, Patent Document 3). Also, a method for producing a photosensitive substance has been proposed, which comprises a step of coating a slurry containing at least an inorganic non-metal particle and a monobasic phosphate on an aluminum surface and thoroughly dehydrating and drying it at a temperature of at least 230° C. or more to form a hydrophilic ceramic layer, and a step of forming an organic photosensitive layer on the hydrophilic ceramic layer (see, Patent Document 4).

However, the hydrophilic layer for a lithographic printing plate is a layer formed by utilizing the self-film-forming property of the alumina sol and the film strength is weak. Therefore, the hydrophilic layer and a lithographic printing plate support where the layer is provided are inferior in the scratch resistance and when a lithographic printing plate is produced, poor press life may result.

The lithographic printing plate having provided thereon the hydrophilic ceramic layer sometimes fails in having a sufficiently high staining resistance. Furthermore, this hydrophilic ceramic layer is formed through a drying step at a high temperature exceeding 230° C. and the drying equipment capable of performing such high-temperature drying is generally expensive. In addition, if dried at an excessively high temperature (for example, 260° C. or more), the aluminum plate where the hydrophilic ceramic layer is provided is softened to impair the excellent dimensional precision stability or the like of the aluminum plate and particularly, plate elongation sometimes occurs at the printing to cause a trouble that the substrate and the image come out of register.

In many cases, a lithographic printing plate obtained by using such a lithographic printing plate support where the hydrophilic layer for a lithographic printing plate or the hydrophilic ceramic layer is provided suffers from inferior press life and inferior staining resistance in the mass printing of producing a large number of printed matters. The improvement of these printing performances is demanded.

In performing the printing by using a lithographic printing plate, an operation of adjusting the amount of fountain solution (water amount) during printing is generally necessary. At this operation, when light is excessively reflected on the plate surface, the adjustment to a proper water amount becomes difficult and staining is sometimes generated. Therefore, the reflection of light must be suppressed to a certain degree or less on the surface of a lithographic printing plate support, which works out to a non-image area of the lithographic printing plate.

In both of the above-described lithographic printing plate supports, the reflection amount of light increases and when mounted on a press, the plate surface shines even with a small water amount. This phenomenon is called "shiny" and this is an undesired phenomenon from the standpoint of confirming the adjustment of water amount (suitability for plate inspection). Improvement of this phenomenon is also demanded.

| | |
|---|---|
| Patent Document 1: | JP-A-2001-318458 |
| Patent Document 2: | JP-A-2002-2133 |
| Patent Document 3: | JP-A-2000-169758 |
| Patent Document 4: | U.S. Pat. No. 4,542,089 |

SUMMARY OF INVENTION

An object of the present invention is to provide, by overcoming the defects in these techniques, a lithographic printing plate support which comprises a film having scratch resistance equal to or higher than that of an anodic oxide film and ensures all of excellent sensitivity of a lithographic printing precursor produced and excellent staining resistance and excellent press life of a lithographic printing plate produced, and also provide a lithographic printing plate precursor using the support.

Another object of the present invention is to provide a lithographic printing plate support for use in a lithographic printing plate precursor having excellent sensitivity and capable of giving a lithographic printing plate excellent in all of the press life, staining resistance and shiny property (property such that when the printing plate is mounted on a press, the plate surface less shines), and also provide a production method of the support.

Still another object of the present invention is to provide a lithographic printing plate support having these properties and capable of reducing the production cost.

Other objects of the present invention will become apparent from the description below.

As a result of intensive investigations, the present inventors have found that when metal oxide particles are bound by a compound containing a metal atom and a phosphorus atom on a substrate, a porous layer having taken therein a suitable amount of air can be formed and the porous layer has excellent heat insulating property and strong film strength, and also found that a lithographic printing plate support where such a porous layer is provided ensures excellent staining resistance, excellent press life and sensitivity equal to or higher than that of a lithographic printing plate support where an anodic oxide film is provided. Furthermore, it has been found that when the surface roughness of the lithographic printing plate support where the porous layer is provided is set to fall within a predetermined range, excellence in the heat insulating property, scratch resistance, press life and staining resistance of the porous layer is not impaired and the press life and shiny property can be improved to a higher level.

In addition, the present inventors have found an efficient production method for a lithographic printing plate support having the above-described surface roughness.

The present invention has been accomplished based on these findings and provides the following (1) to (8).

(1) A lithographic printing plate support comprising a substrate having thereon a porous layer comprising metal oxide particles bound by a compound containing a metal atom and a phosphorus atom.

(2) The lithographic printing plate support as described in (1) above, wherein the metal oxide is an oxide or composite oxide of at least one metal selected from the group consisting of silicon, magnesium, zirconium and titanium.

(3) The lithographic printing plate support as described in (1) above, wherein a thickness of the porous layer is from 0.5 to 20 μm and a surface roughness Ra of the support is from 0.3 to 2.0 μm.

(4) The lithographic printing plate support as described in (1) or (2) above, wherein a pore-sealing layer is further provided on the porous layer.

(5) The lithographic printing plate support as described in (4) above, wherein a thickness of the porous layer is from 0.5 to 20 μm, a thickness of the pore-sealing layer is from 0.01 to 0.5 μm and a surface roughness Ra of the support is from 0.3 to 2.0 μm.

(6) A lithographic printing plate support comprising a substrate having thereon an interlayer formed from a composition comprising an alumina particle, a high-porosity particle, a phosphoric acid and an aluminum compound.

(7) The lithographic printing plate support as described in (1), (2) or (6), wherein the substrate is an aluminum plate, an aluminum-laminated paper, an aluminum-laminated resin or an aluminum-coated metal.

(8) A method for producing a lithographic printing plate support comprising a substrate having thereon a porous layer and a pore-sealing layer in his order, which comprises surface-roughening the substrate, providing the porous layer comprising metal oxide particles bound by a compound containing a metal atom and a phosphorus atom on the surface-roughened substrate, and providing the pore-sealing layer on the porous layer.

DETAILED DESCRIPTION OF THE INVENTION

Figure 1:
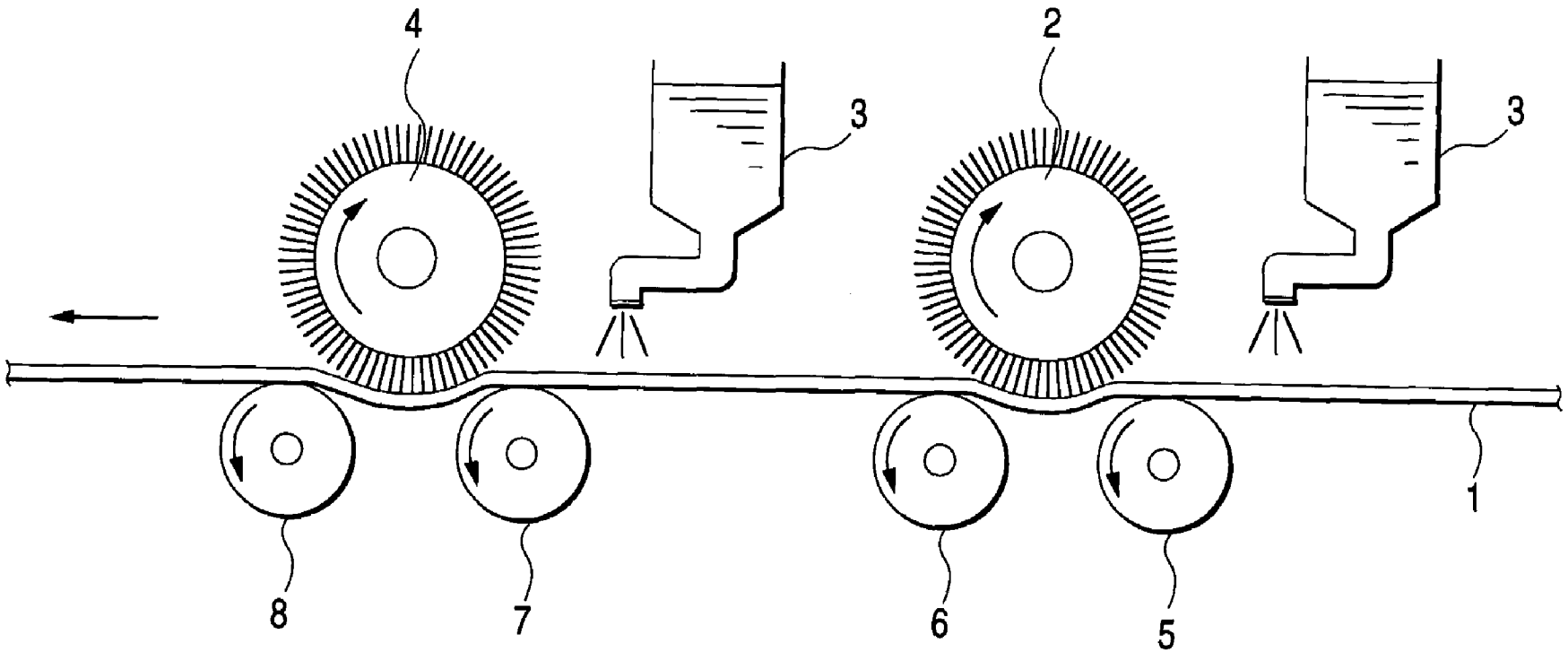
FIG. 1 is a schematic side view showing the concept of the brush graining process used in the mechanical surface-roughening treatment for the production of the lithographic printing plate support of the present invention.

In the present invention, the term "sensitivity" means the sensitivity of a lithographic printing plate precursor produced and the terms "staining resistance", "press life" and "shiny property" are the staining resistance, press life and shiny property of a lithographic printing plate produced respectively.

According to the present invention, a lithographic printing plate support which enables the plate-making particularly by scan-exposure based on digital signals and ensures scratch resistance, excellent sensitivity, staining resistance, shiny property and press life all in a level equal to or higher than that of a lithographic printing plate support where an anodic oxide film is provided, further ensures reduction in the production cost in addition to those properties, and a production method thereof can be provided.

The lithographic printing plate support and lithographic printing plate precursor of the present invention are described in detail below.

<Lithographic Printing Plate Support>

<Porous Layer>

The lithographic printing plate support of the present invention is characterized by having on a substrate a porous layer comprising metal oxide particles bound by a compound containing a metal atom and a phosphorus atom (hereinafter referred to as a "porous layer of the present invention").

The porous layer of the present invention provided on a substrate is a layer where a large number of metal oxide particles are bound through a compound containing a metal atom and a phosphorus atom. This is believed to be a layer where the surface of individual metal oxide particles is partially, preferably entirely, covered with the compound containing a metal atom and a phosphorus atom and the compound containing a metal atom and a phosphorus atom is solidified, as a result, a plurality of metal oxide particles covered with the compound are bound in the aggregated state through the compound containing a metal atom and a phosphorus atom.

A void portion is formed between the bound particles and air can be taken into the void to increase the porosity of the porous layer, whereby the heat insulating property is enhanced. Furthermore, the particles are bound through the compound containing a metal atom and a phosphorus atom and therefore, the porous layer is strong in the film strength and ensures excellent scratch resistance and also excellent press life.

The metal oxide particles bound in the formation of the porous layer are a metal oxide particle having a part of the surface of a metal oxide described below which reacts with a phosphoric acid-base compound. The particles are believed to remain without greatly decreasing in the particle size.

That is, one of the characteristic features of the present invention is to dissolve the surface of the metal oxide particle (not dissolve the whole).

Examples of the method for dissolving the surface include a method where the conditions (e.g., temperature, pH) in the state of a coating solution (slurry) which is described later are set to scarcely cause a reaction between the metal oxide particle and a phosphoric acid-base compound but when the pH lowers and a high-temperature state is formed during the coating or drying of the coating solution, the conditions are changed to cause the reaction.

Specific examples thereof include a method of specifying the drying temperature (preferably further specifying the drying time) in the drying step which is described later, a method of specifying the amount of the metal oxide reacting with a phosphorus-base compound which is described later, a method of adding a catalyst, a reaction accelerator or the like, and an appropriate combination of these methods.

The average particle size and the like of the metal oxide particles constituting the porous layer are not particularly limited and these vary depending on the particle size of the metal oxide used in the coating solution which is described later.

The metal oxide and the particle thereof are fundamentally the same as those described later for a coating solution.

The compound containing a metal atom and a phosphorus atom and constituting the porous layer is, for example, a reaction product between a phosphorus-base compound described later and a metal oxide, or a reaction product between the phosphorus-base compound and a reaction accelerator described later. The compound functions as a binder for binding the metal oxide particles with each other.

The compound varies depending on the metal oxide and phosphoric acid-base compound used and the reaction accelerator which is arbitrarily used, and cannot be unequivocally specified but may contain other atoms such as oxygen atom. Examples of the compound include, when MgO is used as the metal oxide, $Mg_2P_1O_7$ and $Mg_3(PO)_4$. Other examples include those described in *Kagaku* (*Chemistry*), Nippon Kagaku Kyokai, Vol. 31, No. 11, pp. 895-897.

The compound containing a metal atom and a phosphorus atom is not limited to the above-described compounds but may be a compound having a "binding group containing a metal atom and a phosphorus atom", which binds metal oxide particles with each other. The binding group may have a high molecular weight.

The composition of the compound or binding group containing a metal atom and a phosphorus atom is not particularly limited.

For the formation of the porous layer of the present invention, as described later, for example, a reaction accelerator containing a metal atom different from the metal atom in the metal oxide may be used. Therefore, the metal atom in the compound containing a metal atom and a phosphorus atom may be a metal atom originated from the reaction accelerator.

The metal atom in the compound containing a metal atom and a phosphorus atom is preferably a metal atom similar to the metal atom of the metal oxide, more preferably a metal atom originated from the metal oxide.

In the porous layer, the presence ratio and the like between the metal oxide particle and the compound containing a metal atom and a phosphorus atom are not particularly limited. The amount of the compound containing a metal atom and a phosphorus atom is from at least an amount of realizing the binding of metal oxide particles to less than an amount of causing complete filling of the void between particles. The amount is determined, for example, by the composition of a coating solution which is described later.

The porous layer of the present invention may contain other compounds in addition to the metal oxide particle and the compound containing a metal atom and a phosphorus atom.

Examples of other compounds include a dispersant and a reaction accelerator, which are described later, and also include a reaction product between such a compound and the metal oxide or the compound containing a metal atom and a phosphorus atom.

The porous layer preferably has a porosity of 20% or more, more preferably 40% or more, still more preferably 45% or more. When the porosity is 20% or more, a suitable amount of air can be taken into the porous layer and therefore, excellent heat insulating property and high sensitivity can be obtained.

Furthermore, for attaining excellent press life while maintaining the strong film strength of the porous layer, the porosity is preferably 70% or less, more preferably 60% or less.

The porosity of the porous layer can be determined from the thickness of the porous layer, which is described later, and the weight of the porous layer after drying.

More specifically, the density of the porous layer is calculated according to the following formula. For this purpose, the weight of the porous layer after drying is measured to determine the weight of film per unit area and the thickness of the porous layer is measured by a method described later.

$$\text{Density } (g/cm^3) = (\text{weight of film per unit area/thickness}).$$

Based on the calculated density, the porosity of the porous layer can be determined according to the following formula:

$$\text{Porosity } (\%) = \{1 - (\text{density of porous layer}/D)\} \times 100$$

wherein D is a density ($g/cm^3$) of the metal oxide used for the formation of the porous layer, which is known in *Kagaku Binran* (*Handbook of Chemistry*).

The porous layer of the present invention preferably has a thickness of 0.5 to 20 μm, more preferably from 1 to 10 μm, still more preferably from 3 to 7 μm. When the thickness is 0.5 μm or more, the porous layer can have strong film strength to ensure excellent scratch resistance and press life and also, the porous layer can have high heat insulating property to ensure excellent sensitivity.

The upper bound of the thickness is set to 20 μm because more effect cannot be obtained and the cost increases, however, the upper bound is not limited thereto and the thickness may exceed 20 μm.

In the measurement of the thickness of the porous layer, a lithographic printing plate support where the porous layer is provided is bent to produce a broken face and the broken face is observed and photographed by an ultrahigh-resolution scanning electron microscope (for example, S-900, manufactured by Hitachi Ltd.). The magnification for observation is appropriately adjusted according to the layer thickness or the like. Specifically, the magnification is preferably from 100 to 10,000 times.

Then, the thickness of the porous layer portion in the obtained image data (photograph) is measured and converted to determine the thickness of the porous layer.

The porous layer of the present invention may be a single layer or may comprise a plurality of layers by superposing two or more layers.

In the case of a plurality of layers, same porous layers may be superposed or porous layers differing in the composition may be superposed. The thickness of each layer is not particularly limited and the layers may have the same thickness or may be different in the thickness.

The plurality of layers may be formed, for example, by alternately repeating a coating step of applying a coating solution and a drying step of drying the coating solution, described later.

The porous layer can be formed on a substrate by a method comprising a coating step of applying a coating solution containing a particulate metal oxide and a phosphoric acid-base compound on a substrate and a drying step of drying under heating at 180 to 500° C. the coating solution coated on the substrate.

That is, the lithographic printing plate support of the present invention is a lithographic printing plate support comprising a substrate having thereon a porous layer obtained by applying a coating solution containing a particulate metal oxide and a phosphoric acid-base compound on the substrate and drying the coating solution at 180 to 500° C.

The details of the reaction mechanism in the formation of the porous layer are not known, but the present inventors believe the mechanism as follows. It is described by taking magnesia (MgO) as an example.

The reaction between magnesia and phosphoric acid takes place according to the following formulae (1) and (2) and the metal oxide particles are bound by the produced $Mg_2P_2O_7$ or the like. When the coating solution is completely dried, $MgHPO_4$ produced according to formula (1) may also function as the binder.

$$MgO + H_3PO_4 \xrightarrow{20^\circ C.} MgHPO_4 + H_2O \quad (1)$$

$$2MgHPO_4 \xrightarrow{200\text{-}300^\circ C.} Mg_2P_2O_7 + H_2O \quad (2)$$

More specifically, when the pH of the coating solution containing a particulate metal oxide and a phosphoric acid-base compound is in a preferred range which is described later, the surface of the metal oxide particle slightly dissolves under the acidic condition and this provides a state such that both the metal oxide of which surface is dissolved and the metal oxide dissolved out readily react with the phosphoric acid-base compound. Furthermore, under the acidic condition, the surface of the substrate also reacts with the phosphoric acid-base compound and is activated.

After the coating solution is coated, preferably in the drying step, water in the coating solution is removed to increase the concentration of the phosphoric acid-base compound and at the same time, the temperature of the coating solution and substrate is elevated, as a result, the substrate, the metal oxide of which surface is dissolved and the metal oxide dissolved out react with the phosphoric acid-base compound to gradually produce a sparingly water-soluble compound containing a metal atom and a phosphorus atom. This sparingly water-soluble compound functions as the binder for binding metal oxide particles with each other and a porous layer where a plurality of metal oxide particles are bound and a suitable amount of air is taken in is formed.

The porous layer bound by the sparingly water-soluble compound is taking in a suitable amount of air and therefore, exhibits excellent heat insulating property. Furthermore, since the porous layer is bound by the compound, the film strength becomes strong.

In such a mechanism, when a reaction accelerator is used, the above-described reactions take place at a lower temperature and $Mg_2P_2O_7$ or the like functioning as the binder is more easily produced at a lower temperature. This is effective particularly when an aluminum plate unsuitable for high-temperature drying is used as the substrate. The aluminum plate can be prevented from softening due to high temperature and a lithographic printing plate having excellent properties can be obtained.

These reactions between a phosphoric acid-base compound and a metal oxide are described in detail in *Kagaku* (*Chemistry*), Nippon Kagaku Kyokai, Vol. 31, No. 11, pp. 895-897 (1976).

The coating solution for use in the coating step of applying a coating solution containing a particulate metal oxide and a phosphoric acid-base compound on a substrate is described below.

The metal oxide contained in the coating solution used for forming the porous layer of the present invention is not particularly limited as long as it reacts with a phosphoric acid-base compound, which is described later, to form a film. Examples thereof include oxides of metals described in *Zhurnal Prikladnoi Khimii*, Vol. 38, No. 7, pp. 1466-1472 (July, 1965). Specific examples thereof include oxides of Al, Si, Ti, Zr, Y, Nd, La, Mg, Ca, Sr, Ba, Cr, Co, Fe, Ni, Sn, Pb, Cu, Zn, Cd and Mn. Among these, an oxide or composite oxide of at least one or more metal selected from the group consisting of Si, Mg, Zr and Ti is preferred.

More specifically, examples of the metal oxide used for the formation of the porous layer of the present invention include metal oxides such as $SiO_2$, $TiO_2$, $Al_2O_3$, $ZrO_2$, $Y_2O_3$, $Nd_2O_3$, $La_2O_3$, MgO, CaO, SrO, BaO, $MnO_2$, $CrO_2$, $Co_2O_3$, $Fe_2O_3$, $Mn_2O_3$, NiO, FeO, MnO, $SnO_2$, $PbO_2$, CuO, ZnO and CdO, and mixed oxides of these metal oxides, such as $SiO_2/Al_2O_3$ and $MgO/Al_2O$.

Examples of the composite oxide include $2SiO_2.3Al_2O_3$ (mullite).

Specifically, commercial products of various alumina fine particles such as AKP Series, AKP-G Series, HIT Series, AM Series (produced by Sumitomo Chemical Co., Ltd.) and NANOTEC Series (common name: ultrafine particle, produced by C.I. Kasei Co., Ltd.) can be used as the metal oxide particle.

More specifically, the followings can be used.

$SiO_2$ (TOWANALITE FTB, average particle size: 12 μm, produced by Towana; Quartz Sand SP-80, average particle size: 5.5 μm, produced by Sanei Silica; SI-0010, average particle size: 10 μm, reagent produced by Soekawa Rikagaku), MgO (Ube Materials 2000A, average particle size: 0.2 μm, produced by Ube Industries, Ltd.; MG-0076, average particle size: 2 mm, reagent produced by Soekawa Rikagaku), $ZrO_2$ (NANOTEC Series (common name: ultrafine particle) $ZrO_2$, average particle size: 0.03 μm, produced by C.I. Kasei Co., Ltd.; ZR-0049, average particle size: 8 μm, reagent produced by Soekawa Rikagaku), $TiO_2$ (rutile, TI-0057, average particle size: 1 to 2 μm, reagent produced by Soekawa Rikagaku), $SiO_2/Al_2O_3$ (NANOTEC Series (common name: ultrafine particle) $SiO_2/Al_2O_3$, average particle size: 0.03 μm, produced by C.I. Kasei Co., Ltd.), $MgO/Al_2O_3$ (NANOTEC Series (common name: ultrafine particle) $MgO/Al_2O_3$, average particle size: 0.05 μm, produced by C.I. Kasei Co., Ltd.), $2SiO_2.3Al_2O_3$ (mixed oxide mullite (powder), average particle size: 0.8 μm, produced by KCM Corporation; AL-0111, average particle size: 5 mm, reagent produced by Soekawa Rikagaku), etc.

Besides the above, those commercially available in general can be used without any particular limitation.

These particles are used after adjusting the average particle size, if desired, by grinding or the like.

In addition to the metal oxide, an oxide of other metals may be contained. Examples of the oxide of other metals include oxides of metals and the like other than those described above.

The content of the metal oxide used for the formation of the porous layer of the present invention is not particularly limited but is preferably from 10 to 100 wt %, more preferably from 40 to 100 wt %, of the entire metal oxide including the oxide of other metals.

In the present invention, the metal oxide is in the particle form so as to taken in a suitable amount of air and enhance the heat insulating property, however, as long as the effect of the present invention is provided, the particle may have any shape such as spherical form, polyhedral (for example, eicosahedral or dodecahedral) form, cubic form, tetrahedral form, so-called comfit-like form, plate-like form or needle-like form. From the standpoint that a spherical particle is readily formed by the reaction with a metal oxide which is described later or with the compound containing a metal atom and a phosphorus atom and excellent heat insulating property is attained, the shape is preferably spherical, polyhedral, cubic, tetrahedral or comfit-like. The spherical shape is also preferred because the spherical particle is easily available and more excellent heat insulating property is obtained.

A mixture of particles having these shapes or a hollow particle having such a shape may also be used.

The average particle size of the particle is not particularly limited but is preferably from 0.01 to 5 μm, more preferably from 0.03 to 3 μm, still more preferably from 0.1 to 1.5 μm. With the average particle size in such a range, strong film strength can be attained and adjustment to the above-described suitable porosity is facilitated.

In the case where, for example, the adhesion to the image-recording layer is insufficient, two or more kinds of metal oxide particles differing in the average particle size may be mixed so as to increase the surface roughness. In such a case, the average particle size of the first metal oxide particle is preferably from 0.01 to 5 μm, more preferably from 0.03 to 3 μm, still more preferably from 0.1 to 1.5 μm, and the average particle size of the second metal oxide particle is preferably from 2 to 50 times, more preferably from 3 to 20 times, still more preferably from 4 to 10 times, the average particle size of the first metal oxide particle.

By mixing the second metal oxide particle having an average particle size larger than the average particle size of the first metal oxide particle, desired surface roughness can be attained.

The content of the metal oxide in the coating solution is appropriately adjusted according to the desired porosity and thickness of the porous layer, but in general, it is preferably from 5 to 60 wt %.

The content can also be adjusted so as to cause dissolution of the metal oxide surface by calculating the amount of reaction with a phosphoric acid-base compound (that is, the produced amount of the compound containing a metal atom and a phosphorus atom) which is described later. It is believed that the produced amount of the compound containing a metal atom and a phosphorus atom can be adjusted, for example, by making constant the surface area of metal oxide particles used.

More specifically, in the case of forming a porous layer on other substrate by using metal oxide particles differing in the average particle size, the surface area of metal oxide particles is fixed by the following method so as to produce a constant amount of the compound containing a metal atom and a phosphorus atom.

For example, assuming that

Particle A having average particle radius of $r_1$, density of $d_1$ and weight of $W_1$ and Particle B having average particle radius of $r_2$, density of $d_2$ and weight of $W_2$ are used, the surface area $S_1$ of Particle A is $3W_1/(r_1 \times d_1)$ and the surface area $S_2$ of Particle B is $3W_2/(r_2 \times d_2)$, therefore, when the surface areas $S_1$ and $S_2$ are fixed, the amount $W_2$ of Particle B used can be determined by the following formula:

$$W_2=[(r_2 \times d_2)/(r_1 \times d_1)] \times W_1$$

The phosphoric acid-base compound contained in the coating solution used for the formation of the porous layer of the present invention is not particularly limited and examples thereof include oxo acids such as phosphinic acid, phosphorous acid, diphosphorous acid, hypophosphoric acid, phosphoric acid (e.g., orthophosphoic acid), diphosphoric acid, triphosphoric acid, metaphosphoric acid, peroxophosphoric acid and condensed phosphoric acid, and salts resulting from replacing from 1 to 3 hydrogen atoms of these acids by a metal atom such as sodium or potassium salt.

Among these, preferred are phosphoric acid (e.g., orthophosphoric acid) and salts resulting from replacing from 1 to 3 hydrogen atoms of the acid by a metal atom such as sodium or potassium salt.

The concentration and the like of the acid is not particularly limited and an acid in general (for example, commercially available acid) may be used.

The content of the phosphoric acid-base compound in the coating solution is not particularly limited but is preferably from 0.05 to 12 wt %, more preferably from 0.1 to 10 wt %, still more preferably from 0.3 to 8 wt %.

With the phosphoric acid-base compound content in such a range, the porous layer can have strong film strength and high porosity.

The combination of the metal oxide and the phosphoric acid-base compound is preferably, for example, a metal oxide such as $SiO_2$, MgO, $ZrO_2$ and $TiO_2$, a mixed oxide such as $SiO_2/Al_2O_3$ and $MgO/Al_2O_3$, or a composite oxide such as $2SiO_2.3Al_2O_3$ (mullite), with a phosphoric acid or sodium dihydrogenphosphate ($NaH_2PO_4$).

The coating solution preferably contains a dispersant for uniformly dispersing the metal oxide, a reaction accelerator for accelerating the reaction between the metal oxide and the compound containing a metal atom and a phosphorus atom, or the like.

The dispersant is not particularly limited but those commonly known as a dispersant for metal oxides and the like, such as citric acid and sodium hexametaphosphate, can be used. The content thereof in the coating solution, which is also not particularly limited, is ordinarily from 0.1 to 1 wt %, preferably from 0.2 to 0.8 wt %, more preferably from 0.2 to 0.5 wt %.

The reaction accelerator is not particularly limited but, for example, a reaction accelerator described below is preferably used depending on the metal oxide used. The content (amount used) of the accelerator, which is also not particularly limited, can be variously changed depending to the desired thickness, porosity or the like of the porous layer. When the content is in the range described later, the compound containing a metal atom and a phosphorus atom can be produced at a lower temperature and even when an aluminum plate is used for the substrate, the aluminum plate can be prevented from softening and a lithographic printing plate having excellent properties can be obtained.

When the metal oxide used is $SiO_2$, the reaction accelerator is preferably sodium fluoride and the content thereof is preferably from 1 to 5 wt % based on $SiO_2$.

When the metal oxide used is MgO, the reaction accelerator is preferably zirconium phosphate and the content thereof is preferably from 3 to 30 wt % based on MgO.

When the metal oxide used is $ZrO_2$, the reaction accelerator is preferably aluminum phosphate and the content thereof is preferably from 3 to 30 wt % based on $ZrO_2$.

When the metal oxide used is a mixed oxide such as $SiO_2/Al_2O_3$ or $MgO/Al_2O_3$, an oxide containing a composite oxide alumina such as $2SiO_2.3Al_2O_3$ (mullite), or $TiO_2$, the reaction accelerator is preferably aluminum chloride and the content thereof is preferably from 5 to 100 wt %, more preferably from 10 to 80 wt %, based on $Al_2O_3$ or $TiO_2$.

The solvent of the coating solution is preferably water.

The coating solution is prepared by dispersing or dissolving the above-described particulate metal oxide, phosphoric acid-base compound and if desired, dispersant, reaction accelerator and the like in water.

The coating solution is preferably prepared by charging and dispersing the particulate metal oxide in an aqueous solution containing the dispersant and after uniformly dispersing the solution, charging and stirring the phosphorus-base compound and if desired, the reaction accelerator in the aqueous solution.

The thus-prepared coating solution is coated on a substrate which is described later, thereby completing the coating step.

For the coating, various methods can be used. Examples thereof include bar coater coating, spin coating, spray coating, curtain coating, dip coating, air knife coating, blade coating and roll coating.

Then, a drying step of drying the coating solution coated on the substrate is performed under heating at 180 to 500° C.

The drying method is not particularly limited and a commonly employed method can be selected. The drying temperature is preferably from 180 to 500° C. In the case of using an aluminum plate for the substrate, the drying temperature is preferably from 180 to 220° C. When the drying temperature is in such a range, the aluminum plate can be prevented from softening and a lithographic printing plate having excellent properties can be obtained. In the case where a metal sheet except for aluminum plate is used for the substrate, the metal sheet is free of the problem of softening and therefore, the drying temperature is not particularly limited and is preferably from 180 to 500° C. For example, in the case of an iron-base substrate such as stainless steel sheet, the drying temperature is more preferably from 200 to 400° C.

By performing the drying step, the surface of the particulate metal oxide can be reacted with the phosphoric acid-base compound and the particulate metal oxide can be made to remain without greatly reducing the size thereof.

The drying time is not particularly limited if it is long to such an extent that water of the coating solution can be removed, but the drying time in general is preferably from 10 to 300 seconds, more preferably from 30 to 180 seconds.

The porous layer of the present invention can be formed on the substrate through the above-described steps, however, other steps may be performed in addition to those steps.

As described above, the porous layer of the present invention can be formed by coating a coating solution containing a particulate metal oxide and a phosphoric acid-base compound on a substrate and drying the coating solution, so that the production process is simple and easy and the cost can be curtailed.

<Pore-Sealing Layer>

The porous layer of the present invention has a high porosity and has a large number of pores on the surface thereof. Therefore, when a lithographic printing plate precursor is produced by directly providing an image recording layer on the porous layer formed on the substrate, a residual color phenomenon that a dye as an image recording layer component intrudes into pores of the porous layer and remains after the development, or a residual layer phenomenon that a binder as an image recording layer component remains after the development is caused in some cases.

In order to avoid such a phenomenon, a pore-sealing treatment of sealing the pores of the porous layer having a high porosity is preferably performed before providing the image recording layer. The pore-sealing treatment is preferably a treatment of providing a pore-sealing layer (hereinafter also referred to as a "hydrophilic layer").

That is, the lithographic printing plate support of the present invention is preferably a lithographic printing plate support obtained by providing a pore-sealing layer on the porous layer of the present invention.

The pore-sealing layer is not particularly limited but a pore-sealing layer containing a silicate compound and a hydrophilic resin is preferred.

The pore-sealing layer can be provided by forming a hydrophilic film comprising a hydrophilic composition on the high-porosity porous layer. The thickness of the pore-sealing layer can be appropriately determined according to the desired properties such as hydrophilicity and strength, but the layer thickness in general is preferably from 0.01 to 0.5 μm, more preferably from 0.05 to 0.3 μm. When the layer thickness is in such a range, necessary hydrophilicity can be obtained and at the same time, the hydrophilic film can be prevented from separation or cracking due to slight bending at the printing or the like.

In the lithographic printing plate support having a porous layer and a pore-sealing layer of the present invention, it is more preferred that the thickness of the porous layer is from 0.5 to 20 μm and the thickness of the pore-sealing layer is from 0.01 to 0.5 μm. The preferred ranges of these thicknesses are as described above.

The thickness of the pore-sealing layer can be measured by observing a broken face produced resulting from bending of a lithographic printing plate support where the pore-sealing layer is provided, through an ultrahigh-resolution scanning electron microscope (for example, S-900, manufactured by Hitachi Ltd.). The magnification for observation is appropriately adjusted depending on the layer thickness or the like. Specifically, the magnification is preferably from 100 to 10,000 times.

When, for example, a relatively large-size hollow particle such as shirasu balloon is used in the pore-sealing layer, the performance as well as the layer thickness can be more enhanced. Also, when the relatively large-size powder material and a small-size powder particle are used as a mixture, a film having all of heat insulating property, hydrophilicity and furthermore, strength can be formed and this is a particularly preferred embodiment as a lithographic printing plate support for a lithographic printing plate precursor where a heat-sensitive image recording layer is provided.

The optimum coverage of the pore-sealing layer varies depending on the thickness of the porous layer, the amount or distribution of the light-to-heat converting agent contained in the image recording layer, the thickness of the image recording layer, the laser scanning speed of the exposure apparatus used, the laser output, exposure beam shape or the like, but the optimum coverage can be experimentally determined within the range from 0.01 to 0.5 μm. The coverage of the pore-sealing layer and whether the pores of the porous layer are uniformly sealed can be observed by a high-magnification electron microscope.

Examples of the silicate compound which is preferably used for the pore-sealing layer include alkali silicate-base water glass such as sodium silicate, potassium silicate and lithium silicate. The content of the silicate compound varies depending on the kind of the hydrophilic resin used together, but the content in general is preferably from 30 to 45 wt % as $SiO_2$ or from 30 to 45 wt % as $Na_2O$, based on all solid contents constituting the pore-sealing layer.

The silicate compound, particularly the water glass or the like which is preferably used, has high hydrophilicity and therefore, exerts a function as a hydrophilizing agent. However, with the water glass alone, the film-forming property is poor because dehydration shrinkage takes place during drying to generate fine cracking or problems such as formation of non-uniform film may arise. Therefore, if the water glass is used alone, the press life is worsened in some cases. In the present invention, a hydrophilic resin is used in combination and the hydrophilic resin exhibits curing behavior different from that of water glass during the drying, so that a uniform film free of cracking can be formed by virtue of the complementary activity.

In the silicate compound, additives, for example, a curing agent for alkali silicate known under trade names such as CAS and PC-500 (both produced by Nissan Chemicals Industries, Ltd.), may be added in an appropriate amount.

The hydrophilic resin which is preferably used for the pore-sealing layer of the lithographic printing plate support of the present invention is not particularly limited and examples thereof include known synthetic resins having excellent hydrophilicity, such as polyacrylic acid, polyvinyl alcohol and polyvinyl phosphonic acid, and various hydrophilic resin compounds known as alkali-soluble resin, such as novolak resin, phenol-aldehyde resin, m-cresol formaldehyde resin and p-cresol formaldehyde resin. When a water glass is used as the silicate compound, an acidic hydrophilic resin compound is not preferred because the water glass is generally present in an alkaline sol form and if these are mixed, gelling occurs and a uniform film can be hardly formed by a normal coating method. Therefore, in such a case, a hydrophilic resin soluble in a neutral or alkaline aqueous solvent is preferably used in view of suitability for production.

However, the gelled product obtained by mixing a water glass and an acidic hydrophilic resin may also be used by grinding it in a mortar, a high-speed shearing mixer or the like to fine gels of about 1 μm or less, thoroughly washing them with water and re-dispersing the fine gels in an alkaline aqueous solvent or a water glass. When used in such a way, predetermined hydrophilicity and film properties can be obtained and therefore, the hydrophilic resin is not necessarily limited to a neutral or alkaline hydrophilic resin.

The content of the hydrophilic resin varies depending on the desired properties such as hydrophilicity and film strength, or the kind or amount of the silicate compound used together, however, the content in general is preferably from 4 to 40 wt % based on all solid contents constituting the pore-sealing layer.

If the hydrophilic resin is used alone without using the water glass, the staining resistance and ink-repelling performance are sometimes deteriorated due to insufficient hydrophilicity.

The content ratio [($SiO_2$+$Na_2O$)(wt %)/hydrophilic resin (wt %)] of the silicate compound [$SiO_2$+$Na_2O$ (wt %)] and the hydrophilic resin [wt %] in the pore-sealing layer is preferably from 10 to 99. If the proportion of the silicate compound excessively increases, the film property is deteriorated to cause fine cracks in the film or the stamina resistance or press life tends to decrease, whereas if the proportion of the hydrophilic resin excessively increases, the hydrophilicity decreases and staining is readily generated on the non-image area.

In the hydrophilic composition constituting the pore-sealing layer, for the purpose of enhancing the handleability and film property, additives such as plasticizer, surfactant and solvent may be used in combination within the range of not impairing the effect of the present invention. Particularly, in the case of using conventional polyvinyl alcohol (PVA) or the like as the hydrophilic resin, for the purpose of improving the water resistance thereof, a heat-reactive crosslinking agent such as ETESTRON BN-69 (produced by Dai-ichi Kogyo Seiyaku Co., Ltd.) is preferably added in an appropriate amount.

Examples of the method for forming the pore-sealing layer on the porous layer include a method of coating a hydrophilic composition having blended therein the above-described components and additives used, if desired, in combination on the porous layer by a spray method, a bar coating method or the like to form a liquid film and drying it with hot air at 100 to 180° C., thereby solidifying the film.

The porosity of the thus-formed pore-sealing layer is not particularly limited. In the lithographic printing plate support having a porous layer and a pore-sealing layer of the present invention, the porosity of the porous layer is 20% or more and the porosity of the pore-sealing layer is lower than that of the porous layer. When the porosity of the pore-sealing layer is set to be lower than that of the porous layer, a large number of pores present on the surface of the porous layer can be effectively sealed and residual color and residual film phenomena caused by the intrusion of an image recording layer into pores can be prevented. The preferred range of the porosity of the porous layer is as described above.

In the measurement of the porosity of the pore-sealing layer, a lithographic printing plate support where the pore-sealing layer is provided is bent to produce a broken face and the broken face is observed and photographed by an ultra-high-resolution scanning electron microscope (for example, S-900, manufactured by Hitachi Ltd.). In the 3 cm×3 cm range of the obtained image data (photograph), the area ratio of the void portion is measured. The operation is performed at 5 to 10 places and the arithmetic mean thereof is defined as the porosity.

The magnification for observation is appropriately adjusted depending on the thickness of the pore-sealing layer observed.

By forming the pore-sealing layer on the porous layer, a support more preferred as the lithographic printing plate support of the present invention can be obtained. By virtue of the properties of the porous layer, preferably properties of the porous layer and pore-sealing layer, the support can express excellent surface hydrophilicity and heat insulating property even without providing an anodic oxide film and furthermore, exhibits good film properties and excellent adhesion to the image recording layer or substrate. Therefore, when a lithographic printing plate is produced by using the support, heat generated upon exposure can be efficiently used for the image formation to ensure excellent sensitivity, the non-image area excellent in the surface hydrophilicity is free of staining due to excellent ink repellency, and also excellent press life and scratch resistance can be obtained.

In a preferred embodiment of the lithographic printing plate support of the present invention, the thickness of the porous layer is from 0.5 to 20 μm, the thickness of the pore-sealing layer is from 0.01 to 0.5 μm and the surface roughness Ra of the support is from 0.3 to 2.0 μm. The surface roughness Ra is described in detail below.

The surface roughness Ra is an index showing the uneven shape including large corrugation on the surface of the lithographic printing plate support. When the surface roughness Ra is set to the above-described range, high heat insulating property and excellent scratch resistance, press life and staining resistance of the porous layer provided on the lithographic printing plate support are not impaired and furthermore, the press life and shiny property can be improved to a higher level.

The reason why the press life and shiny property can be improved is not quite clear but this is considered as follows.

When the surface roughness Ra is large, the surface becomes rough and the water retentivity on the non-image area of the lithographic printing plate becomes large to hardly cause regular reflection of light, as a result, the plate face less shines when a fountain solution is supplied to the non-image area of the lithographic printing plate at the printing, so that the amount of the fountain solution supplied can be visually confirmed and the control of the amount (plate inspection) is facilitated to give excellent shiny property.

Furthermore, when the surface roughness Ra is large, the surface area contacting with the image recording layer provided on the support (on the pore-sealing layer) is increased to give strong adhesive strength and therefore, the press life can be improved to a higher level.

On the other hand, even when the surface roughness of the porous layer is limited to the above-described range, the void in the porous layer is maintained and since the porous layer has a large thickness and is hard, high heat insulating property and excellent scratch resistance, press life and staining resistance which are original properties of the porous layer are not impaired.

In the present invention, the surface roughness Ra is from 0.3 to 2.0 μm from the standpoint that the press life and shiny property are satisfied in a higher level, the properties of the porous layer are not impaired and the local unevenness in the thickness of the heat-sensitive layer provided on the lithographic printing plate support can be suppressed.

In the lithographic printing plate support of the present invention, the surface average roughness Ra is measured as follows.

A two-dimensional roughness measurement is performed by a stylus-type roughness meter (for example, Sufcom 575, manufactured by Tokyo Seimitsu Co., Ltd.) and the average roughness Ra specified in ISO4287 is measured 5 times. The average thereof is defined as the average roughness.

The conditions in the two-dimensional roughness measurement are as follows.

<Measurement Conditions>

Cut-off value: 0.8 mm, inclination correction: FLAT-ML, measured length: 3 mm, longitudinal magnification: 10,000 times, scanning speed: 0.3 mm/sec, tip diameter of stylus: 2 μm.

According to the present invention, a heat-sensitive image recording layer is provided on the support having a porous layer and a pore-sealing layer, whereby a lithographic printing plate precursor can be obtained. By virtue of such a constitution, a lithographic printing plate precursor capable of forming image with high-sensitivity and high-resolution and having excellent printing suitability can be obtained, where light energy by exposure, for example, laser light used for writing, can be efficiently used as the heat energy necessary for the image formation.

<Interlayer>

In another embodiment of the lithographic printing plate support of the present invention, a coating solution comprising an alumina particle, a high-porosity particle, a phosphoric acid and an aluminum compound is coated on a substrate, preferably a substrate with an aluminum surface, to form a high-porosity and hard ceramic layer (hereinafter also referred to as a high-porosity hard ceramic layer or an interlayer). By virtue of such a constitution, higher sensitivity can be obtained and a lithographic printing plate support excellent in the difficult staining, press life and scratch resistance and advantageous in view of production cost can be provided.

The high-porosity hard ceramic interlayer is formed, for example, by mixing the following Solutions A and B and coating and drying (at 120 to 180° C.) it. The reaction mechanism is shown below.

Solution A:

alumina powder+high-porosity particle+85 wt % phosphoric acid+citric acid

Solution B:

$AlCl_3$ (reaction accelerator)

$$Al_2O_3+H_3PO_3 \rightarrow 2AlPO_4.XH_2O+Al(H_2PO_4)+AlH_2P_3O_{10}+H_2O+ \quad (1)$$

$$AlCl_3+3H_3O \rightarrow Al(OH)_3+HCl\uparrow \quad (2)$$

$$Al(OH)_3+H_3PO_4 \rightarrow 2AlPO_4.XH_2O+Al(H_2PO_4)+AlH_2P_3O_{10}+H_2O \quad (3)$$

Formulae (2) and (3) show the reaction acceleration effect of aluminum chloride and the right side of formulae (1) and (3) are the composition components of the film. In the present invention, the interlayer film further contains a high-porosity particle.

The formation of the high-porosity hard ceramic layer which can work out to the interlayer is described in detail in L. F. Francis (Univ. Minnesota, Minn.), *Ad RepRP* AD-A-322561, page 10 (1997). The interlayer of the present invention may be formed by appropriately referring to this publication.

The alumina particle used for forming the interlayer of the lithographic printing plate support of the present invention is not particularly limited but preferably has an average particle size of 0.05 to 5 μm, more preferably from 0.08 to 1 μm, still more preferably from 0.1 to 0.5 μm.

In the case where the adhesion to a layer provided on the support is insufficient, two or more alumina particles differing in the average particle size may be contained so as to increase the surface roughness. In such a case, the average particle size of the first alumina particle is preferably from 0.05 to 5 μm, more preferably from 0.08 to 1 μ, still more preferably from 0.1 to 0.5 μm. The average particle size of the second alumina particle is preferably from 2 to 50 times, more preferably from 3 to 20 times, still more preferably from 4 to 10 times, the average particle size of the first alumina particle. By mixing the second particle, a desired surface roughness can be obtained.

Specific examples of suitable alumina particles include commercial products of various alumina fine particles such as AKP Series, AKP-G Series, HIT Series, AM Series (produced by Sumitomo Chemical Co., Ltd.) and NANOTEC Ultrafine Particle (produced by C.I. Kasei Co., Ltd.)

The alumina particle content in the coating solution used for forming the interlayer is appropriately adjusted depending on the desired porosity and thickness of the inter layer but is preferably from 35 to 55 wt %, more preferably from 40 to 50 wt %, in the coating solution.

The content of the phosphoric acid in the coating solution used for forming the interlayer is not particularly limited but is preferably from 0.05 to 12 wt %, more preferably from 0.1 to 10 wt %, still more preferably from 0.3 to 8 wt %.

Suitable examples of the high-porosity particle for use in the present invention include a hollow particle. For the hollow particle as a characteristic constitutional element for holding independent pores in the inter layer of the present invention, the followings can be used, however, the present invention is of course not limited thereto.

Examples of the inorganic hollow particle include a silica-base inorganic fine particle called shirasu balloon. The shirasu balloon which has been developed by Kyushu Kogyo Shikenjo is obtained by baking and foaming vitreous volcanic ash such as shirasu (white sand) and mainly comprises aluminosilicate glass. Hollow particles in tens of μm are obtained. Also, hollow particles having an average particle size of 10 μm or less can be produced by the studies of Sodeyama et al. Such a particle is being used as a filler of lightweight aggregate of cement or paint or as a lightweight fire-resisting building material and commercially available from Shiraccsu, Sannki Kako Kenki, Showa Mining Co., Ltd., Seishin Sangyo and the like.

The hollow particle for use in the present invention is not limited to the above-described silica-base hollow particle but a titanium oxide-base hollow particle may also be used. In addition, a very fine hollow particle of 1 to 10 nm obtained by rapidly mixing a silicon compound and an aluminum compound solution and after removing the by-product salts, performing hydrothermal synthesis described in JP-A-10-236818, and a zinc oxide hollow particle of approximately from 0.05 to 0.1 μm described in JP-A-7-328421 can also be suitably used.

Examples of the organic hollow particle include the hollow particles described in *Zairyo Gijutsu* (*Material Technology*), Vol. 11, No. 3, 22-30 (1993). In the present invention, the production method thereof is not limited but, for example, emulsion polymerization, emulsion polymerization and suspension polymerization of gas foaming type are known as the general production method of an organic hollow particle. The product is available from Dai-Nippon Ink & Chemicals, Inc., Mitsui Chemicals, Inc., ZEON Corporation, JSR and the like. It is used for uses such as organic pigment for coated paper, lightweighting agent for resin, and white turbidity-imparting agent.

In addition to these hollow particles, a porous particle or an anisotropic particle is also suitable as the high-porosity particle for use in the present invention. The porous particle as used herein means a particle having fine pores inside the particle and the particle is generally characterized in that the specific surface area measured by the gas adsorption method is large as compared with normal non-porous particles having a particle size on the same level. The specific surface area of the porous particle is approximately from 50 to 200 $m^2/g$ in many cases. The anisotropic particle means a particle not forming a spherical shape at multi-point approximation of the outer shape thereof and being not isotropic such as needle-like, feather-like or tabular particle.

Examples of the aluminum compound used for forming the interlayer of the present invention include aluminum halides. Among these, aluminum chloride is preferred.

The aluminum compound functions as a reaction accelerator. When aluminum chloride is used as the reaction accelerator, the content thereof in the coating solution used for forming the interlayer is not particularly limited, but the weight ratio thereof to alumina is preferably $AlCl_3$: $Al_2O_3$=from 0.01:1 to 0.3:1, more preferably $AlCl_3$: $Al_2O_3$=from 0.01:1 to 0.2:1, still more preferably $AlCl_3$: $Al_2O_3$=from 0.01:1 to 0.1:1.

In the coating solution used for forming the interlayer, a dispersant of various types is preferably contained so as to uniformly disperse the alumina in water. The dispersant is not particularly limited but those generally known as a dispersant for alumina, such as citric acid and sodium hexametaphosphate, can be used. The content of the dispersant in the coating solution, which is not particularly limited, is from 0.1 to 1 wt %, preferably from 0.2 to 0.8 wt %, more preferably from 0.2 to 0.5 wt %.

The average thickness of the interlayer of the present invention is preferably from 1 to 50 μm, more preferably from 3 to 40 μm, still more preferably from 5 to 30 μm. Within such a range, good heat insulating property and strength can be obtained and when a heat-sensitive lithographic printing plate is produced, sufficiently high sensitivity can be obtained. The porosity of the interlayer is preferably from 5 to 70%, more preferably from 10 to 60%, still more preferably from 15 to 50%. Within such a range, good heat insulating property and strength can be obtained and when a heat-sensitive lithographic printing plate is produced, sufficiently high sensitivity can be obtained.

The above-described porosity is a value calculated from the weight W ($g/m^2$) of the interlayer and the layer thickness d (μm) thereof according to the following formula:

$$\text{Porosity } V\,(\%)=\{1-(W/d/3.89)\}\times 100$$

In the above, the film weight W ($g/m^2$) of the interlayer is a value measured according to the Maison method (JIS H8680-1993, Film Weight Method). As the layer thickness d (μm), an aluminum plate strip having an interlayer is embedded in a resin and cut, the cross section thereof is finally finished by buff-polishing with 0.1 μm alumina and observed by SEM to measure the thickness, and the average of values obtained by observing randomly selected 20 points is employed.

<Hydrophilic Layer>

The high-porosity hard ceramic interlayer has a high porosity and therefore, has a large number of pores on the surface thereof. When a heat-sensitive layer is provided directly on the high-porosity hard ceramic layer for applying the support of the present invention to a lithographic printing plate, residual color deterioration that a dye as a heat-sensitive layer component intrudes into pores and remains after the development, or residual layer deterioration that a binder as a heat-sensitive layer component remains after the development is caused. In order to avoid such reduction, the high-porosity hard ceramic interlayer must be subjected to a pore-sealing treatment before providing the heat-sensitive layer. The pore-sealing treatment is preferably performed by providing a pore-sealing hydrophilic layer (hereinafter sometimes simply referred to as a "hydrophilic layer").

The pore-sealing hydrophilic layer is not particularly limited but a hydrophilic layer containing a silicate compound and a hydrophilic resin is preferred.

The hydrophilic layer can be provided by forming a hydrophilic film comprising a hydrophilic composition on the high-porosity hard ceramic interlayer. The thickness of the hydrophilic layer can be appropriately determined according to the desired properties such as hydrophilicity and strength, but the layer thickness in general is preferably from 0.2 to 50 μm, more preferably from 1 to 8 μm. When the layer thickness is in such a range, necessary hydrophilicity can be obtained and at the same time, the hydrophilic film can be prevented from separation or cracking due to slight bending at the printing or the like.

When, for example, a relatively large-size hollow particle such as shirasu balloon is used in the hydrophilic layer, the performance as well as the layer thickness can be more enhanced. Also, when the relatively large-size powder material and a small-size powder particle are used as a mixture, a film having all of heat insulating property, hydrophilicity and furthermore, strength can be formed and this is a particularly preferred embodiment as a lithographic printing plate support having thereon a heat-sensitive layer.

Examples of the silicate compound which is preferably used for the hydrophilic layer of the present invention include alkali silicate-base water glass such as sodium silicate, potassium silicate and lithium silicate. The content of the silicate compound varies depending on the kind of the hydrophilic resin used together, but the content in general is preferably from 30 to 45 wt % as $SiO_2$ or from 30 to 45 wt % as $Na_2O$, based on all solid contents constituting the hydrophilic layer.

The silicate compound, particularly the water glass or the like which is preferably used, has high hydrophilicity and therefore, exerts a function as a hydrophilizing agent. However, the water glass alone, the film-forming property is poor because dehydration shrinkage takes place during drying to generate fine cracking or problems such as formation of non-uniform film may arise. Therefore, if the water glass is used alone, the press life is worsened. In the present invention, a hydrophilic resin is used in combination and the hydrophilic resin exhibits curing behavior different from that of water glass during the drying, so that a uniform film free of cracking can be formed by virtue of the complementary activity.

In the silicate compound, additives, for example, a curing agent for alkali silicate known under trade names such as CAS and PC-500 (both produced by Nissan Chemicals Industries, Ltd.), may be added in an appropriate amount.

The hydrophilic resin which is preferably used for the hydrophilic layer of the support of the present invention is not particularly limited and examples thereof include known synthetic resins having excellent hydrophilicity, such as polyacrylic acid, polyvinyl alcohol and polyvinyl phosphonic acid.

When a water glass is used as the silicate compound, an acidic hydrophilic resin compound is not preferred because the water glass is generally present in an alkaline sol form and if these are mixed, gelling occurs and a uniform film can be hardly formed by a normal coating method. Therefore, in such a case, a hydrophilic resin soluble in a neutral or alkaline aqueous solvent is preferably used in view of suitability for production.

However, the gelled product obtained by mixing a water glass and an acidic hydrophilic resin may also be used by grinding it in a mortar, a high-speed shearing mixer or the like to fine gels of about 1 μm or less, thoroughly washing them with water and re-dispersing the fine gels in an alkaline aqueous solvent or a water glass. When used in such a way, predetermined hydrophilicity and film properties can be obtained and therefore, the hydrophilic is not necessarily limited to a neutral or alkaline hydrophilic resin.

The content of the hydrophilic resin varies depending on the desired properties such as hydrophilicity and film strength, or the kind or amount of the silicate compound used together, however, the content in general is preferably from 4 to 40 wt % based on all solid contents constituting the hydrophilic layer.

If the hydrophilic resin is used alone without using the water glass, staining resistance and ink-repelling performance are sometimes deteriorated due to insufficient hydrophilicity.

The content ratio [($SiO_2$+$Na_2O$)(wt %)/hydrophilic resin (wt %)] of the silicate compound [$SiO_2$+$Na_2O$ (wt %)] and the hydrophilic resin [wt %] in the hydrophilic layer is preferably from 1 to 9. Within such a range, preferred staining property and press life can be obtained.

In addition to the above-described compounds, a powder mainly comprising an inorganic component (hereinafter also referred to as an inorganic fine particle) may be mixed, whereby effects such as enhancement in the hardness of the hydrophilic layer, enhancement of the heat insulating property, improvement in the optical properties such as whiteness and glossiness, and enhancement in the adhesive strength to substrate or heat-sensitive layer due to increase of the surface area can be obtained. Furthermore, the properties inherent in the inorganic fine particle are reflected and thereby, the reflection or absorption of infrared ray used for exposure can be effectively enhanced or various functions such as catalytic activity can be added.

As the inorganic fine particle preferably used in the present invention, in view of improvement in the dispersibility in the hydrophilic layer, an inorganic fine particle mainly comprising a hydrophilic inorganic component or an inorganic fine particle of which surface is subjected to a hydrophilic surface modification treatment is preferably used.

Examples of the inorganic component which can be used include, as the metal, metal materials having hydrophilicity, such as Al, Fe, Pt, Pd and Au alloy. Also carbons such as coal, charcoal, diamond, DLC (diamond-like coating), graphite and glassy carbon, oxides, nitrides, silicides and carbides are preferably used.

Specific examples of the oxide, nitride, silicide and carbide are set forth below. Specific examples of the oxide include aluminum oxide, silicon oxide, titanium oxide, zirconium oxide, hafnium oxide, vanadium oxide, niobium oxide, tantalum oxide, molybdenum oxide, tungsten oxide, chromium oxide, germanium oxide, gallium oxide, tin oxide and indium oxide. Specific examples of the nitride include aluminum nitride, silicon nitride, titanium nitride, zirconium nitride, hafnium nitride, vanadium nitride, niobium nitride, tantalum nitride, molybdenum nitride, tungsten nitride, chromium nitride, silicon nitride and boron nitride. Specific examples of the silicide include titanium silicide, zirconium silicide, hafnium silicide, vanadium silicide, niobium silicide, tantalum silicide, molybdenum silicide, tungsten silicide and chromium silicide. Specific examples of the boride include titanium boride, zirconium boride, hafnium boride, vanadium boride, niobium boride, tantalum boride, molybdenum boride, tungsten boride and chromium boride. Specific examples of the carbide include aluminum carbide, silicon carbide, titanium carbide, zirconium carbide, hafnium carbide, vanadium carbide, niobium carbide, tantalum carbide, molybdenum carbide, tungsten carbide and chromium carbide.

Among these, preferred metals are aluminum and titanium, and preferred oxides are aluminum oxide, iron oxide, titanium oxide, indium oxide, tin oxide, silicon oxide and the like. A fine particle mainly comprising any one component of these is preferred. These inorganic components may be used not only as a simple substance but also as a mixture.

As for the shape, the inorganic fine particle may be any of a spherical particle, a columnar particle, a flaked powder particle, a hollow particle, a porous particle and an amorphous particle, but in view of the effect of enhancing the hydrophilicity and sensitivity, a flaked powder particle, a hollow particle and a porous particle are most suitable.

The size of the fine particle varies depending on the desired properties of the hydrophilic layer, but in general, the diameter is preferably on the order of 0.01 to 10 μm.

The content of the inorganic fine particle is appropriately selected depending on the purpose of blending, but in general, the content is preferably on the order of 4 to 40 wt %.

One of these inorganic fine particles may be used alone or a plurality of the inorganic fine particles may be used in combination. Also, a mixture of powder particles each comprising a plurality of different inorganic components may be used. Furthermore, as described above, a plurality of inorganic fine particles differing in the size (particle size) may be used in combination.

In the case of blending the inorganic fine particle, out of the components constituting the hydrophilic layer, the hydrophilic resin is preferably blended in an amount reduced by the amount equal to the amount of the inorganic fine particle blended. The blending ratio in the hydrophilic layer containing the inorganic fine particle is preferably $1<[(SiO_2+Na_2O)(wt\ \%)/(\text{hydrophilic resin}+\text{inorganic fine particle})(wt\ \%)]<9$.

In the hydrophilic composition constituting the hydrophilic layer, for the purpose of enhancing the handleability and film property, additives such as plasticizer, surfactant and solvent may be used in combination within the range of not impairing the effect of the present invention. Particularly, in the case of using conventional polyvinyl alcohol (PVA) or the like as the hydrophilic resin, for the purpose of improving the water resistance thereof, a heat-reactive crosslinking agent such as ETESTRON BN-69 (produced by Dai-ichi Kogyo Seiyaku Co., Ltd.) is preferably added in an appropriate amount.

Examples of the method for forming the hydrophilic layer on the interlayer include a method of coating a hydrophilic composition having blended therein the above-described components and additives used, if desired, in combination on the interlayer by a spray method, a bar coating method or the like to form a liquid film and drying it with hot air at 100 to 180° C., thereby solidifying the film.

By forming the hydrophilic layer on the interlayer, a support more preferred as the lithographic printing plate support of the present invention can be obtained. By virtue of the properties of the interlayer and hydrophilic layer, the support can express excellent surface hydrophilicity and heat insulating property even without providing an anodic oxide film and furthermore, exhibits good film properties and excellent adhesion to the heat-sensitive layer or substrate.

Therefore, when a heat-sensitive lithographic printing plate is produced by using the support, heat generated upon exposure with an infrared laser can be efficiently used for the image formation to ensure high sensitivity, the non-image area excellent in the surface hydrophilicity is favored with good difficult staining due to excellent ink repellency, and also good press life is obtained due to excellent adhesive property.

Furthermore, the lithographic printing plate support is advantageous in view of the production cost, because an anodic oxide film need not be provided.

<Substrate>

The substrate for use in the lithographic printing plate support of the present invention is not particularly limited and examples thereof include a pure aluminum plate, alloy sheets mainly comprising aluminum and containing a trace of foreign elements, various metal sheets mainly comprising a metal element except for aluminum, these alloy sheets or metal sheets which are coated, and plastic films laminated or evaporated with a metal such as aluminum.

Preferred examples of the alloy sheet mainly comprising aluminum and containing a trace of foreign elements include an aluminum alloy plate which is described later. Preferred examples of various metal sheets mainly comprising a metal element except for aluminum include metal sheets having flexibility and high strength and being inexpensive, such as stainless steel sheet, nickel sheet, copper sheet and magnesium alloy sheet.

Preferred examples of the coated alloy sheet or metal sheet include the above-described alloy sheets or various metal sheets on which a metal atom, a metal oxide or the like is coated as a thin layer by sputtering, lamination or the like. The metal atom or metal oxide is more preferably the same metal oxide or metal atom thereof as used for the formation of the porous layer.

Among these, preferred as the substrate for use in the present invention are those various metal sheets free from the problem of softening due to heating, on which the same metal oxide or metal atom thereof as used for the formation of the porous layer is coated as a thin layer by sputtering, lamination or the like. Also, inexpensive aluminum plates having excellent rust prevention, high recycling property, small specific gravity and good handleability are preferred.

In the case of a substrate obtained by coating the above-described various metal sheets, the stainless steel sheet, nickel sheet or the like may be coated by sputtering under normal conditions or may be coated by lamination or the like.

The layer thickness of the coating, which is not particularly limited, is generally about 10 nm or more, preferably from 10 to 100 nm, more preferably from 25 to 50 nm. In general, if the layer thickness of the coating is small, the metal sheet cannot be sufficiently coated and the adhesion to the porous layer of the present invention is sometimes poor, whereas if the layer thickness is large, this costs high. Therefore, in the present invention, the layer thickness is appropriately selected by taking account of these points.

Those various metal sheets and substrates obtained by coating the metal sheets for use in the present invention may be commercial products.

The substrate for use in the lithographic printing plate support of the present invention is preferably a substrate having an aluminum surface. Examples of the substrate include, an aluminum substrate, an aluminum-laminated paper or resin, and an aluminum-coated substrate.

Among these, aluminum is preferred because this has excellent rust prevention, high recycling property and good handleability due to its small specific gravity and is inexpensive.

The aluminum plate preferred as the substrate for use in the present invention is described below.

The composition of the aluminum plate for use in the present invention is not particularly limited and conventionally known materials described, for example, in *Aluminum Handbook,* 4th ed., Keikinzoku Kyokai (1990), such as Al—Mn base aluminum plate (e.g., JIS A1050, JIS A1100, JIS A1070, Mn-containing JIS A3004, international registered alloy 3103A), may be used. Also, Al—Mg base alloys and Al—Mn—Mg base alloys (JIS A3005), obtained by adding 0.1 wt % or more of magnesium to the above-described aluminum alloys for the purpose of increasing the tensile strength, may be used. Furthermore, aluminum alloys containing Zr or Si, that is, Al—Zr base alloys and Al—Si base alloys may also be used. In addition, Al—Mg—Si alloys may also be used.

With respect to the JIS1050 material, the techniques proposed by the present applicant are described in JP-A-59-153861, JP-A-61-51395, JP-A-62-146694, JP-A-60-215725, JP-A-60-215726, JP-A-60-215727, JP-A-60-216728, JP-A-61-272367, JP-A-58-11759, JP-A-58-42493, JP-A-58-221254, JP-A-62-148295, JP-A-4-254545, JP-A-165041, JP-B-3-68939 (the term "JP-B" as used herein means an "examined Japanese patent publication"), JP-A-3-234594, JP-B-1-47545 and JP-A-62-140894. Also, techniques described in JP-B-1-35910, JP-B-55-28874 and the like are known.

With respect to the JIS1070 material, the techniques proposed by the present applicant are described in JP-A-7-81264, JP-A-7-305133, JP-A-8-49034, JP-A-8-73974, JP-A-8-108659 and JP-A-8-92679.

With respect to the Al—Mg base alloy, the techniques proposed by the present applicant are described in JP-B-62-5080, JP-B-63-60823, JP-B-3-61753, JP-A-60-203496, JP-A-60-203497, JP-B-3-11635, JP-A-61-274993, JP-A-62-23794, JP-A-63-47347, JP-A-63-47348, JP-A-63-47349, JP-A-64-1293, JP-A-63-135294, JP-A-63-87288, JP-B-4-73392, JP-B-7-100844, JP-A-62-149856, JP-B-4-73394, JP-A-62-181191, JP-B-5-76530, JP-A-63-30294 and JP-B-6-37116. Also, such a material is described in JP-A-2-215599, JP-A-61-201747 and the like.

With respect to the Al—Mn base alloy, the techniques proposed by the present applicant are described in JP-A-60-230951, JP-A-1-306288 and JP-A-2-293189. Also, such a material is described in JP-B-54-42284, JP-B-4-19290, JP-B-4-19291, JP-B-4-19292, JP-A-61-35995, JP-A-64-51992, J-A-4-226394, U.S. Pat. Nos. 5,009,722 and 5,028,276, and the like.

With respect to the Al—Mn—Mg base alloy, the techniques proposed by the present applicant are described in JP-A-62-86143 and JP-A-3-222796. Also, such a material is described in JP-B-63-60824, JP-A-60-63346, JP-A-60-

63347, JP-A-1-293350, European Patent 223,737, U.S. Pat. No. 4,818,300, British Patent 1,222,777 and the like.

With respect to the Al—Zr base alloy, the techniques proposed by the present applicant are described in JP-B-63-15978 and JP-A-61-51395. Also, such a material is described in JP-A-63-143234 and JP-A-63-143235.

The Al—Mg—Si base alloy is described in British Patent 1,421,710 and the like.

The aluminum alloy may be formed into a plate material, for example, by the following method. First, a molten aluminum alloy adjusted to have a predetermined alloy component content is purified and cast by an ordinary manner. In the purification, for removing unnecessary gases such as hydrogen in the melt, a flux treatment, a degassing treatment using argon gas, chlorine gas or the like, a filtering treatment using a so-called rigid media filter such as ceramic tube filter or ceramic foam filter, a filter employing alumina flake, alumina ball or the like as the filter material, a glass cloth filter or the like, or a combination of the degassing treatment and the filtering treatment is performed.

In order to prevent the defects due to foreign matters such as non-metal inclusion and oxide in the melt or the defects due to gases mixed into the melt, it is preferred to perform the purification. The filtering of the melt is described in JP-A-6-57432, JP-A-3-162530, JP-A-5-140659, JP-A-4-231425, JP-A-4-276031, JP-A-5-311261, JP-A-6-136466 and the like. The degassing of the melt is described in JP-A-5-51659 and JP-UM-A-5-49148 (the term "JP-UM-A" as used herein means an "unexamined published Japanese utility model application"). The present applicant have also proposed a technique on the degassing of the melt in JP-A-7-40017.

Then, the thus-purified melt is cast. The casting method includes a method of using a fixed mold, represented by the DC casting, and a method of using a driven mold, represented by the continuous casting.

In the DC casting, the solidification occurs at a cooling rate of 0.5 to 30° C./sec. If it is less than 1° C., many coarse intermetallic compounds may be formed. When the DC casting is performed, an ingot having a plate thickness of 300 to 800 mm can be produced. The ingot is, if desired, scalped in an ordinary manner. Usually, from 1 to 30 mm, preferably from 1 to 10 mm, of the surface layer is scalped. Before or after the scalping, soaking is performed, if desired. In the case of performing the soaking, a heat treatment is performed at 450 to 620° C. for 1 to 48 hours so as not to coarsen the intermetallic compounds. If the heat-treatment time is less than one hour, insufficient soaking effect may result.

Thereafter, hot rolling and cold rolling are performed to obtain an aluminum rolled plate. The hot rolling initiation temperature is suitably from 350 to 500° C. Before, after or during the hot rolling, intermediate annealing may be performed. The intermediate annealing is performed by heating the aluminum plate in a batchwise annealing furnace at 280 to 600° C. for 2 to 20 hours, preferably at 350 to 500° C. for 2 to 10 hours, or in a continuous annealing furnace at 400 600° C. for 6 minutes or less, preferably at 450 to 550° C. for 2 minutes or less. Also, the crystal structure may be made fine by heating the aluminum plate in a continuous annealing furnace at a temperature-rising rate of 10 to 200° C./sec.

The aluminum plate finished to a predetermined thickness, for example, from 0.1 to 0.6 mm through the above-described steps may be further improved in the planarity by a straightening device such as roller leveler or tension leveler. The planarity may be performed after the aluminum plate is cut into a sheet form, however, in order to improve the productivity, it is preferably performed while the aluminum plate is in a continuous coil state. The aluminum plate may also be passed through a slitter line to work it to a predetermined plate width. Furthermore, in order to prevent the generation of scratches due to friction of aluminum plates with each other, a thin oil film may be provided on the surface of the aluminum plate. A volatile or non-volatile oil film is appropriately used, if desired.

The continuous casting method which is employed in industry includes a twin roll method (Hunter method), a method using a cold roller represented by the 3C method, a twin belt method (Hazellett method), and a method using a cooling belt or a cooling block represented by Model Alusuisse Caster II. In the case of using the continuous casting method, solidification occurs at a cooling rate of 100 to 1,000° C./sec. In the continuous casting method, the cooling rate is generally high as compared with the DC casting method and therefore, the method is characterized in the degree of solid solution of alloy components in the aluminum matrix can be increased. With respect to the continuous casting method, the techniques proposed by the present applicant are described in JP-A-3-79798, JP-A-5-201166, JP-A-5-156414, JP-A-6-262203, JP-A-6-122949, JP-A-6-210406 and JP-A-6-262308.

In the case of performing the continuous casting, for example, when a method using a cooling roll such as Hunter method is employed, a cast plate having a plate thickness of 1 to 10 mm can be directly and continuously produced and the hot rolling step can be advantageously dispensed with. Also, when a method using a cooling belt such as Hazellett method is employed, a cast plate having a plate thickness of 10 to 50 mm can be produced and by disposing a hot rolling roller and continuously rolling the aluminum plate immediately after the casting, a continuously cast and rolled plate having a plate thickness of 1 to 10 mm can be obtained.

The continuously cast and rolled plate is, similarly to the DC casting, passed through the steps such as cold rolling, intermediate annealing, improvement of planarity and slit, and thereby finished to a predetermined thickness, for example, from 0.1 to 0.6 mm. With respect to the intermediate annealing conditions and cold rolling conditions in the case of using the continuous casting method, the techniques proposed by the present applicant are described in JP-A-6-220593, JP-A-6-210308, JP-A-7-54111 and JP-A-8-92709.

The aluminum plate produced in such a way is demanded to have the following various properties.

The strength of the aluminum plate is preferably 140 MPa or more as a 0.2% yield strength so as to obtain a firmness required of the lithographic printing plate support. In the case of performing baking treatment, the 0.2% vield strength after heat treatment at 270° C. for 3 to 10 minutes is preferably 80 MPa or more, more preferably 100 MPa or more, so as to obtain a certain firmness. Particularly, when the aluminum plate is required to have a firmness, an aluminum material having added thereto Mg or Mn may be employed, however, the firmness results in deterioration of the easy mounting property to the plate cylinder of a press. Therefore, the amounts of construction materials and trace components added are appropriately selected according to use. With respect to these, the techniques proposed by the present applicant are described in JP-A-7-126820, JP-A-62-140894 and the like.

The crystal structure of the aluminum plate is preferably not so coarse on the surface, because when a chemical surface roughening treatment or an electrochemical surface roughening treatment is performed, the crystal structure on the surface of the aluminum plate sometimes gives rise to the generation of failure in the surface quality. The crystal structure on the surface of the aluminum plate preferably has a width of 200 μm or less, more preferably 100 μm or less, still more preferably 50 μm or less. The length of the crystal structure is preferably 5,000 μm or less, more preferably 1,000 μm or less, still more preferably 500 μm or less. With respect to these, the techniques proposed by the present applicant are described in JP-A-6-218495, JP-A-7-39906, JP-A-7-124609 and the like.

The alloy component distribution of the aluminum plate is preferably not so inhomogeneous on the surface, because when a chemical surface roughening treatment or an electrochemical surface roughening treatment is performed, the inhomogeneous distribution of alloy components on the surface of the aluminum plate sometimes gives rise to the generation of failure in the surface quality. With respect to these, the techniques proposed by the present applicant are described in JP-A-6-48058, JP-A-5-301478, JP-A-7-132689 and the like.

The size or density of intermetallic compounds in the aluminum plate sometimes affects the chemical surface roughening treatment or electrochemical surface roughening treatment. With respect to these, the techniques proposed by the present applicant are described in JP-A-7-138687, JP-A-4-254545 and the like.

In the present invention, asperities may be imparted to the aluminum plate by lamination rolling, transfer or the like in the final rolling step.

The aluminum plate for use in the present invention is a continuous belt-like sheet or plate material. That is, the aluminum plate may be an aluminum web or a flat sheet cut into, for example, a size corresponding to the lithographic printing plate precursor shipped as a product.

The scratch on the surface of the aluminum plate has a possibility of becoming a defect when worked into a lithographic printing plate support, therefore, the generation of scratches must be prevented as much as possible at the stage before the surface treatment of producing a lithographic printing plate precursor. For this purpose, the aluminum plate is preferably packaged in a stable form less having scratches at the transportation.

In the case of an aluminum web, the packaging form of aluminum is, for example, such that a hard board and a felt are spread in an iron-made pallet, a donut-like corrugated board is padded to both ends of the product, the entire is wrapped with a poly-tube, a donut-shaped wood is inserted into the inner part of the coil, a felt is padded to the outer periphery of the coil, an iron belt is braced and an index is applied to the circumference thereof. A polyethylene film can be used as the packaging material and a needle felt or a hard board can be used as the padding. Other than these, various forms may be employed. As long as the transportation or the like can be stably performed without causing scratches, the packaging form is not limited to the method.

The thickness of the substrate for use in the present invention is not particularly limited but it is preferably from about 0.1 to 0.6 mm, more preferably from 0.15 to 0.4 mm, still more preferably from 0.2 to 0.3 mm.

<Surface Treatment>

In the present invention, by providing a porous layer, the lithographic printing plate produced can have both staining resistance and long press life and a lithographic printing plate having excellent printing performance can be obtained. However, if desired, the substrate may be subjected to a surface treatment commonly performed in the production of lithographic printing plates (for example, various surface roughening treatments and anodization).

The lithographic printing plate support of the present invention can be produced through simple steps, that is, coating and drying of the coating solution, and favored with excellent sensitivity, staining resistance and press life even without applying a surface treatment. Therefore, the production cost can be greatly reduced as compared with conventional lithographic printing plate supports obtained by applying a surface roughening treatment.

Furthermore, in the lithographic printing plate support of the present invention, the anodic oxide film is not formed and an electrolysis treatment (a large quantity of electricity) necessary for the formation of the film is not required. Therefore, the cost can be reduced.

<Production Method of Lithographic Printing Plate Support>

The lithographic printing plate support of the present invention is not particularly limited in the production method, but can be produced, for example, by the following methods:

(I) a method where the substrate is surface-roughened, a porous layer comprising metal oxide particles bound by a compound containing a metal atom and a phosphorus atom is provided on the surface-roughened substrate, and a pore-sealing layer is further provided on the porous layer;

(II) a method where a porous layer comprising metal oxide particles bound by a compound containing a metal atom and a phosphorus atom is provided on the substrate, the porous layer is mechanically surface-roughened, and a pore-sealing layer is further provided on the surface-roughened porous layer; and (III) a method where a porous layer comprising two or more kinds of metal oxide particles differing in the average particle size, which are bound by a compound containing a metal atom and a phosphorus atom, is provided on the substrate and a pore-sealing layer is provided on the porous layer.

These production methods (I) to (III) are described below.

<Surface-Roughening Treatment>

In the method (I), the substrate is first surface-roughened.

The surface-roughening treatment is not particularly limited and may includes various surface-roughening treatments commonly performed in the production of a lithographic printing plate support. For example, the substrate may be subjected to anodization before the surface-roughening treatment.

In the present invention, the surface-roughening treatment is preferably a mechanical surface-roughening treatment or a d.c. electrolytic surface-roughening treatment, because the surface roughness Ra can be easily adjusted to the above-described range. The surface-roughening treatment is more preferably a mechanical surface-roughening treatment, because the surface roughness Ra can be more easily adjusted, the operation is simple and the cost is low.

In addition to these surface-roughening treatments, other surface-roughening treatments may be performed.

<Mechanical Surface-Roughening Treatment>

The mechanical surface-roughening treatment can generally form a surface having a surface roughness Ra in the above described range (surface shape having an average wavelength exceeding several μm) at a lower cost as compared with the electrochemical surface-roughening treatment. Therefore, the treatment is effective as means for the surface roughening.

Examples of the method which can be used for the mechanical surface-roughening treatment include a wire brush graining method of scratching the substrate surface with a metal wire, a ball graining method of graining the substrate surface with an abrading ball and an abrasive, and a brush graining method of graining the surface with a nylon brush and an abrasive described in JP-A-6-135175 and JP-B-50-40047.

Also, a transfer method of contact-pressing an uneven surface to the substrate may be used. More specifically, the methods described in JP-A-55-74898, JP-A-60-36195, JP-A-60-203496 and JP-A-7-205565, the method of performing the transfer several times described in JP-A-6-55871, and the method characterized in that the surface is elastic described in JP-A-6-24168 can be used. Examples of the method of forming the uneven surface (transfer grains) include the methods described in JP-A-7-205565, JP-A-6-183168, JP-A-6-55871, JP-A-6-24168, JP-A-6-171261, JP-A-6-171236 and JP-A-60-203496.

Furthermore, a method of repeatedly performing the transfer by using a transfer roll having etched thereon fine asperities by means of electric discharging, shot blasting, laser, plasma etching or the like, and a method of bringing an uneven surface having coated thereon fine particle into contact with the substrate, applying a pressure thereon repeatedly several times, and thereby transferring an uneven pattern corresponding to the average diameter of fine particles onto the substrate repeatedly several times can be used. For imparting fine asperities to the transfer roll, known methods described in JP-A-3-8635, JP-A-3-66404, JP-A-63-65017 and the like can be used. Also, fine grooves may be cut on the roll surface from two directions by using a die, a cutting tool, a laser or the like to form square asperities on the surface. The roll surface may be treated so as to round the formed square asperities by a known etching treatment or the like.

In addition, quenching, hard chrome plating or the like may also be performed so as to increase the hardness of the surface.

Other than these, the methods described in JP-A-61-162351, JP-A-63-104889 and the like may also be used as the mechanical surface-roughening treatment.

A method of blowing a slurry-like aqueous solution containing an abrasive by a high-pressure jet, such as horning, may also be used.

In the present invention, the above-described methods may also be used in combination by taking account of productivity and the like.

Among those methods, the mechanical surface-roughening treatment is preferably performed by a brush graining method or a transfer method, more preferably a brush graining method which is described later.

Among the transfer methods, the method described in JP-A-07-205565 is more preferred. Specifically, according to the transfer method described in JP-A-07-205565, unevenness is transferred to the aluminum substrate surface by using a transfer roll such that the area percentage of independent recesses becomes 5 to 70%, and then a post-treatment by chemical etching is applied to increase the area percentage of those recesses to 75% or more. In the present invention, the post-treatment by chemical etching may or may not be performed.

Among the above-described methods for forming an uneven surface (transfer grains) on the surface of a transfer roll for use in the transfer method, the surface-roughening method using a laser described in JP-A-6-171261 is preferred, because a transfer roll uniformly controlled in the depth, size, disposition and the like of recesses on the formed uneven surface can be obtained.

The transfer roll for use in the transfer method is not limited to a metal-made roll but may be made of a resin or the like. Also, a transfer roll coated with an anticorrosive, a silicone resin conventionally known as a releasing agent or the like may also be used.

The brush graining method which is suitably used as the mechanical surface-roughening treatment is described below.

In the production method (I) of the lithographic printing plate support of the present invention, the mechanical surface-roughening treatment is applied by using a rotary brush and a slurry containing an abrasive.

The brush graining method is performed by rubbing one or both surface(s) of the substrate with a roller brush prepared by embedding a large number of brush bristles such as synthetic resin bristle comprising a synthetic resin (e.g., Nylon (trademark), propylene, vinyl chloride resin) on the surface of a cylindrical barrel, while splashing a slurry containing an abrasive on the rotating roller brush (hereinafter sometimes referred to as a "rotary brush").

The rotary brush for use in the present invention is not particularly limited but a brush having an appropriate bristle strength is preferred.

Examples of the rotary brush include a bundle-embedded brush and a channel brush.

The construction material of the abrasive for use in the present invention is not particularly limited and a known material can be used. For example, abrasives such as pumice stone, quartz sand, aluminum hydroxide, alumina powder, silicon carbide silicon nitride, volcanic ash, carborandom and emery, and a mixture thereof may be used. Among these, preferred are pumice stone, quartz sand and alumina powder.

The shape of the abrasive particle is not particularly limited and examples thereof include a spherical form, a plate-like form, an amorphous form and a geometric steric form with rounded corners.

The abrasive is used in the form of a slurry by suspending it, for example, in water. In addition to the abrasive, the slurry may contain a thickener, a dispersant (for example, surfactant, an antiseptic and the like. The specific gravity of the slurry is preferably from 0.5 to 2.

Examples of the apparatus suitable for the mechanical surface-roughening treatment include the apparatus described in JP-B-50-40047.

FIG. 1 is a schematic side view showing the concept of the brush graining process. As shown in FIG. 1, roller brushes 2 and 4 each is disposed to sandwich a substrate 1 with two supporting rollers 5 and 6 or 7 and 8. Each pair of supporting rollers 5 and 6, and 7 and 8 are disposed such that the minimum distance between outer surfaces thereof becomes smaller than the outer diameter of respective roller brushes 2 and 4. The substrate 1 is pressed by the roller brushes 2 and 4 and conveyed at a constant speed in the state of being pressed in between two supporting rollers 5 and 6 and between 7 and 8 and at the same time, an abrasive slurry 3 is supplied on the substrate 1 to abrade the surface as the roller brushes 2 and 4 rotate.

The d.c. electrolytic surface-roughening treatment suitably used for the production method (I) is a method of performing an electrochemical surface-roughening treatment by using a direct current in a large quantity of electricity. By the treatment, large and deep asperities can be formed and the surface roughness Ra can be easily adjusted to the above-described range.

In the d.c. electrolytic surface-roughening treatment, the total quantity of electricity participating in the anodic reaction of the substrate is preferably from 50 to 1,500 C/dm$^2$, more preferably from 100 to 600 C/dm$^2$. At this time, the current density is preferably from 20 to 200 A/dm$^2$. The treatment time is appropriately selected depending on the conditions such as quantity of electricity.

The electrolytic solution, electrolysis bath and the like for use in the d.c. electrolytic surface-roughening treatment are not particularly limited and those commonly used for the electrochemical surface-roughening treatment using a direct current can be selected.

The substrate surface mechanically surface-roughened treatment by the brush graining method or the substrate surface surface-roughened by the d.c. electrolytic treatment is preferably subjected to an alkali etching treatment to dissolve the edge portions of asperities generated and change the acute asperities to a surface having smooth corrugations.

After the alkali etching treatment, pickling (desmutting treatment) is also preferably performed to remove smuts remaining on the surface.

Furthermore, after the above-described surface-roughening treatment, an anodization treatment may also be applied.

By the mechanical surface-roughening treatment or d.c. electrolytic surface-roughening treatment, a lithographic printing plate support having a surface roughness Ra within the above-described range can be obtained.

When a porous layer is provided on the surface of the surface-roughened aluminum substrate to produce a lithographic printing plate support, the surface roughness Ra of the lithographic printing plate support tends to be small. Accordingly, the surface roughness of the surface roughened aluminum substrate is preferably set to be slightly large, specifically, to 0.5 to 5 μm, more preferably from 0.8 to 3 μm, still more preferably from 1 to 2 μm. When the surface roughness of the surface-roughened aluminum substrate is adjusted to the range, the surface roughness Ra of the lithographic printing plate support produced by providing a porous layer can be adjusted to the range of the present invention, that is, from 0.3 to 2 μm.

On the thus surface-roughened substrate, the porous layer comprising metal oxide particles bound by a compound containing a metal atom and a phosphorus atom is provided. The porous layer is as described above.

<Formation of Pore-Sealing Layer>

On the porous layer formed, a pore-sealing layer is further provided to obtain the lithographic printing plate support of the present invention.

Examples of the method for forming the pore-sealing layer on the porous layer include a method of coating a hydrophilic composition having blended therein the above-described pore-sealing layer constituent components and additives used, if desired, in combination on the porous layer by a spray method, a bar coating method or the like to form a liquid film and drying it with hot air at 100 to 180° C., thereby solidifying the film.

That is, the production method (I) is specifically a production method of a lithographic printing plate support, where the substrate is subjected to a mechanical surface-roughening treatment or a d.c. electrolytic surface-roughening treatment, a coating solution containing a particulate metal oxide and a phosphoric acid-base compound is coated on the surface-roughened substrate, the coating solution coated on the substrate is dried under heating at 180 to 500° C. to provide a porous layer, and a pore-sealing layer is further provided on the porous layer to obtain the lithographic printing plate support of the present invention.

By the production method (I), a lithographic printing plate of which surface has a surface roughness Ra in the above-described range can be obtained.

The method (II) is a method of providing a porous layer comprising metal oxide particles bound by a compound containing a metal atom and a phosphorus atom on the substrate, mechanically surface-roughening the porous layer and further providing a pore-sealing layer on the surface-roughened porous layer.

In this method, a porous layer comprising metal oxide particles bound by a compound containing a metal atom and a phosphorus atom is first provided on the substrate in the same manner as in the production method (I).

In the production method (II), the porous layer provided is then subjected to a mechanical surface-roughening treatment.

At this time, the porous layer formed by coating and the drying the coating solution for the porous layer is difficult to mechanically surface-roughen due to its strong film strength and if the conditions of the treatment are intensified, the layer may be cracked or ruptured. Therefore, the mechanical surface-roughening treatment is preferably performed by intermitting the step of drying the coating solution at the time of providing the porous layer.

In other words, when the mechanical surface-roughening treatment is performed before the porous layer is completely solidified, the cracking, rupturing or the like can be prevented and the surface-roughening treatment of the porous layer can be advantageously performed with good efficiency and good reproducibility.

The stage "before the porous layer is completely solidified" is sufficient if it is in such a state that the surface of the porous layer is solidified in the drying step, and the degree thereof is not particularly limited. This is, for example, a state where the surface of the coating solution of the porous layer is dried but the inside is not dried, and in the case of performing the mechanical surface-roughening treatment by the transfer method of transferring a press pattern to the porous layer by the contact-pressing with a transfer roll, a state where the coating solution of the porous layer does not attach to the transfer roll.

When the porous layer is in the state that the surface is solidified to such an extent, the film strength of the porous layer is strong and therefore, the mechanical surface-roughening treatment can be satisfactorily performed.

The drying conditions and the like for the solidification of the surface cannot be unequivocally determined because these vary depending on the kind of metal oxide contained in the porous layer, the thickness of the porous layer, the amount coated, the drying temperature or the like. However, the drying time can be usually determined by an experiment within the range from about 15 to 70% of the drying time necessary for completely solidifying (drying) the porous layer. Specifically, for example, when the thickness of the porous layer is 5.5 μm, the drying time is generally on the order of 30 to 90 seconds and it may suffice if the porous layer (after being allowed to cool) is not peeled off even when touched with a finger. More specifically, for example, when the thickness of the porous layer comprising $Al_2O_3$ is 5.5 μm, the mechanical surface-roughening treatment can be performed after drying for about 30 seconds.

The mechanical surface-roughening treatment performed in the production method (II) is fundamentally the same as the mechanical surface-roughening treatment described in the production method (I) and among the methods described above, preferred are the brush graining method and the transfer method described in JP-A-7-205565.

In the transfer method, the transfer roll used in transferring a roll pattern by bringing the porous layer in the state that the surface of the porous layer is dried, into contact with a transfer roll is not limited to a metal-made roll but may be made of a resin or the like. Also, a transfer roll coated with an anticorrosive, a general releasing agent silicone resin or the like may also be used.

By the mechanical surface-roughening treatment, a lithographic printing plate support having a surface roughness Ra in the above-described range can be obtained.

The surface roughness Ra of the lithographic printing plate support is scarcely affected by the pore-sealing layer to be thinly provided on the porous layer and therefore, the surface roughness of the porous layer obtained by the mechanical surface-roughening treatment can be set to the same value as the surface roughness Ra of the lithographic printing plate support.

In the production method (II), a pore-sealing layer is then provided on the mechanically surface-roughened porous layer by the same method as described in the production method (I).

That is, the production method (II) is specifically a production method of a lithographic printing plate support, where a coating solution containing a particulate metal oxide and a phosphoric acid-base compound is coated on the substrate, the coating solution coated on the substrate is dried under heating at 180 to 500° C. to provide a porous layer, the porous layer is mechanically surface-roughened, and a pore-sealing layer is further provided on the surface-roughened porous layer to obtain the lithographic printing plate support of the present invention.

The drying under heating preferably dries (solidifies) the surface of the coating solution.

By the production method (II), a lithographic printing plate support of which surface has a surface roughness Ra in the above-described range can be obtained.

The method (III) is a method where a porous layer comprising two or more kinds of metal oxide particles differing in the average particle size, which are bound by a compound containing a metal atom and a phosphorus atom, is provided on the substrate and a pore-sealing layer is provided on the porous layer.

In the production method (III), two or more kinds of metal oxide particles differing in the average particle size are used as the metal oxide particle contained in the coating solution for the porous layer.

When two or more kinds of metal oxide particles differing in the average particle size are used, the surface roughness Ra of the porous layer formed can be easily adjusted and a surface-roughening treatment or the like need not be performed, so that the production cost can be advantageously reduced.

Two or more kinds of metal oxides differing in the average particle size are not particularly limited as long as these are differing in the average particle size. These metal oxides may be the same metal oxide or may be different metal oxides.

Two or more average particle sizes are not particularly limited as long as the surface roughness Ra of the porous layer can be adjusted to the above-described range. These average particle sizes vary depending on the ratio of the particles used (abundance ratio) and cannot be unequivocally determined, however, for example, the average particle size of the first metal oxide particle is preferably from 0.01 to 5 μm, more preferably from 0.03 to 3 μm, still more preferably from 0.1 to 1.5 μm, and the average particle size of the second metal oxide particle is preferably from 2 to 50 times, more preferably from 3 to 20 times, still more preferably from 4 to 10 times, the average particle size of the first metal oxide particle.

Specifically, commercially products of various alumina fine particles such as AKP Series, AKP-G Series, HIT Series, AM Series (produced by Sumitomo Chemical Co., Ltd.) and NANOTEC Series (common name: ultrafine particle, produced by C.I. Kasei Co., Ltd.) can be used as the metal oxide particles.

More specifically, the followings can be used.

Examples of the first metal oxide particle include $SiO_2$ (TOWANALITE FTB, average particle size: 12 μm, produced by Towana; Quartz Sand SP-80, average particle size: 5.5 μm, produced by Sanei Silica; MgO (Ube Materials 2000A, average particle size: 0.2 μm, produced by Ube Industries, Ltd.), $ZrO_2$ (NANOTEC Series (common name: ultrafine particle) $ZrO_2$, average particle size: 0.03 μm, produced by C.I. Kasei Co., Ltd.), $TiO_2$ (rutile, TI-0057, average particle size: 1 to 2 μm, reagent produced by Soekawa Rikagaku), $SiO_2/Al_2O_3$ (NANOTEC Series (common name: ultrafine particle) $SiO_2/Al_2O_3$, average particle size: 0.03 μm, produced by C.I. Kasei Co., Ltd.), $MgO/Al_2O_3$ (NANOTEC Series (common name: ultrafine particle) $MgO/Al_2O_3$, average particle size: 0.05 μm, produced by C.I. Kasei Co., Ltd.) and $2SiO_2.3Al_2O_3$ (mixed oxide mullite (powder), average particle size: 0.8 μm, produced by KCM Corporation). These particles are used after adjusting the particle size, if desired, by grinding or the like.

Examples of the second metal oxide particle include $SiO_2$ (SI-0010, average particle size: 10 μm, reagent produced by Soekawa Rikagaku), MgO (MG-0076, average particle size: 2 mm, reagent produced by Soekawa Rikagaku), $ZrO_2$ (ZR-0049, average particle size: 8 μm, reagent produced by Soekawa Rikagaku), $2SiO_2.3Al_2O_3$ (Al-0111, average particle size: 5 mm, reagent produced by Soekawa Rikagaku).

Other than these, those commercially available in general can be used without any particular limitation.

These particles are used after adjusting the average particle size, if desired, by grinding or the like.

The grinding method is not particularly limited as long as the average particle size can be adjusted, however, for example, a method of adjusting the average particle size by using a mill such as HD A-5 Pot Mill (YTZ-0.2, manufactured by Nikkato Corporation) at a rotation number of about 100 rpm while changing the grinding time in the range from 1 to 100 hours may be used.

In the production method (III), the method for forming a porous layer is fundamentally the same as in the production method (I) except for using two or more kinds of metal oxide particles differing in the average particle size.

In the production method (III), a pore-sealing layer is then provided on the porous layer in the same manner as in the production method (I).

That is, the production method (III) is specifically a production method of a lithographic printing plate support, where a coating solution comprising two or more kinds of particulate metal oxides and a phosphoric acid-base compound is coated on the substrate, the coating solution coated on the substrate is dried under heating at 180 to 500° C. to provide a porous layer, and a pore-sealing layer is provided on the porous layer to obtain the lithographic printing plate support of the present invention.

By the production method (III), a lithographic printing plate support of which surface has a surface roughness Ra in the above-described range can be obtained.

The thus-obtained lithographic printing plate support having a surface roughness in the above-described range of the present invention is excellent in the sensitivity and also excellent in all of the press life, staining resistance and shiny property.

By providing a heat-sensitive image recording layer on the lithographic printing plate support of the present invention, a lithographic printing plate precursor can be obtained. According to the constitution, a lithographic printing plate precursor capable of forming image with high-sensitivity and high-resolution and having excellent printing suitability can be obtained, where light energy by exposure, for example, laser light used for writing, can be efficiently used as the heat energy necessary for the image formation.

<Lithographic Printing Plate Precursor>

The lithographic printing plate precursor of the present invention can be produced by providing an image recording layer described below, such as photosensitive layer or heat-sensitive layer, on the lithographic printing plate support of the present invention.

<Image Recording Layer>

For the image recording layer for use in the present invention, a photosensitive composition is used.

Examples of the photosensitive composition suitably used in the present invention include a thermal positive photosensitive composition containing an alkali-soluble polymer compound and a light-to-heat conversion substance (hereinafter the composition and the image recording layer using the composition are also referred to as a "thermal positive type" composition and a "thermal positive type" image recording layer, respectively), a thermal negative photosensitive composition containing a curable compound and a light-to-heat conversion substance (hereinafter the composition and the image recording layer using the composition are also referred to as a "thermal negative type" composition and a "thermal negative type" image recording layer, respectively), and a photosensitive composition not requiring any particular development step (hereinafter the composition and the image recording layer using the composition are also referred to as a "non-processing type" composition and a "non-processing type" image recording layer, respectively). These suitable photosensitive compositions are described below.

<Thermal Positive Type>

<Photosensitive Layer>

The thermal positive-type photosensitive composition contains a water-insoluble and alkali-soluble polymer compound (in the present invention, referred to as an "alkali-soluble polymer compound") and a light-to-heat conversion substance. In the thermal positive-type image recording layer, the light-to-heat conversion substance converts light of an infrared laser or the like into heat and the heat efficiently dissolves the interaction causing the low alkali solubility of the alkali-soluble polymer compound.

Examples of the alkali-soluble polymer compound include resins having an acidic group within the molecule and a mixture of two or more thereof. Among these, resins having an acidic group such as phenolic hydroxyl group, sulfonamide group (—$SO_2NH$—R (wherein R represents a hydrocarbon group)) and active imino group (—$SO_2NHCOR$, —$SO_2NHSO_2R$ or —$CONHSO_2R$ (wherein R has the same meaning as above)) are preferred in view of solubility in an alkali developer.

In particular, resins having a phenolic hydroxyl group are preferred in view of excellent image forming property with exposure by light such as infrared laser and suitable examples thereof include novolak resins such as phenol-formaldehyde resin, m-cresol-formaldehyde resin, p-cresol-formaldehyde resin, m-/p-mixed cresol-formaldehyde resin, and phenol/(m-, p- or m-/p-mixed) cresol mixture-formaldehyde resin (phenol-cresol-formaldehyde co-condensed resin).

Other suitable examples include polymer compounds described in JP-A-2001-305722 (particularly, paragraphs [0023] to [0042]), polymer compounds containing a repeating unit represented by formula (1) of JP-A-2001-215693, and polymer compounds described in JP-A-2002-311570 (particularly, paragraph [0107]).

The light-to-heat conversion substance is, in view of recording sensitivity, suitably a pigment or dye having light absorption in the infrared region at a wavelength of 700 to 1,200 nm. Examples of the dye include azo dyes, metal complex salt azo dyes, pyrazolone azo dyes, naphthoquinone dyes, anthraquinone dyes, phthalocyanine dyes, carbonium dyes, quinoneimine dyes, methine dyes, cyanine dyes, squarylium dyes, pyrylium salts and metal thiolate complexes (e.g., nickel thiolate complex). Among these, preferred are cyanine dyes, more preferred are cyanine dyes represented by formula (I) of JP-A-2001-305722.

The thermal positive-type photosensitive composition may contain a dissolution inhibitor. Suitable examples of the dissolution inhibitor include the dissolution inhibitors described in JP-A-2001-305722, paragraphs [0053] to [0055].

Furthermore, in the thermal positive-type photo-sensitive composition, a sensitivity-adjusting agent, a print-out agent for obtaining a visible image immediately after heating by the exposure, a compound such as dye as the image colorant, and a surfactant for improving the coatability and processing stability are preferably incorporated as additives. Preferred examples of these additives include the compounds described in JP-A-2001-305722, paragraphs [0056] to [0060].

The photosensitive composition described in detail in JP-A-2001-305722 is preferably used.

The thermal positive-type image recording layer is not limited to a single-layer structure but may also be a two-layer structure.

Suitable examples of the image recording layer having a two-layer structure (multilayer-type image recording layer) include a type where a lower layer excellent in the press life and solvent resistance (hereinafter referred to as "Layer A") is provided near the support and a layer having excellent positive image-forming property (hereinafter referred to as "Layer B") is provided thereon. The type is high in the sensitivity and can realize a wide development latitude. Layer B generally contains a light-to-heat conversion substance. Suitable examples of the light-to-heat conversion substance include the dyes described above.

The resin for use in Layer A is suitably a polymer using, as a copolymerization component, a monomer having a sulfonamide group, an active imino group, a phenolic hydroxy group or the like, because the polymer is excellent in the press life and solvent resistance. The resin for use in Layer B is suitably an aqueous alkali solution-soluble resin having a phenolic hydroxyl group.

In addition to the resin, the compositions used for Layer A and Layer B each may contain various additives, if desired. Specifically, various additives described in JP-A-2002-323769, paragraphs [0062] to [0085] are suitably used. Also, the additives described in JP-A-2001-305722, supra, paragraphs [0053] to [0060] may be suitably used.

The components constituting Layer A and Layer B and the content of each component are preferably selected or set as described in JP-A-11-218914.

<Interlayer>

An interlayer is preferably provided between the support and the thermal positive-type image recording layer. Suitable examples of the component contained in the interlayer include various organic compounds described in JP-A-2001-305722, paragraph [0068].

<Others>

As for the production method of the thermal positive type image recording layer and the plate-making method, the methods described in detail in JP-A-2001-307522 can be used.

<Thermal Negative Type>

The thermal negative-type photosensitive composition contains a curable compound and a light-to-heat conversion substance. The thermal negative-type recording layer is a negative photosensitive layer where the portion irradiated with light of an infrared laser or the like is cured to form an image area.

<Polymerization Layer>

One suitable example of the thermal negative-type image recording layer is a polymerization-type image recording layer (polymerization layer). The polymerization layer contains a light-to-heat conversion substance, a radical generator, a radical polymerizable compound which is a curable compound, and a binder polymer. In the polymerization layer, the light-to-heat conversion substance converts the absorbed infrared light into heat, the heat causes the radical generator to decompose and generate a radical, and the generated radical in turn causes chain polymerization and thereby curing of the radical polymerizable compound.

Examples of the light-to-heat conversion substance include the above-described light-to-heat conversion substances for use in the thermal positive type. Specific examples of the cyanine dye which is particularly preferred include those described in JP-A-2001-133969, paragraphs [0017] to [0019]

Suitable examples of the radical generator include onium salts. In particular, the onium salts described in JP-A-2001-133969, paragraphs [0030] to [0033], are preferred.

Examples of the radical polymerizable compound include compounds having at least one, preferably two or more, terminal ethylenically unsaturated bond.

Suitable examples of the binder polymer include linear organic polymers. Linear organic polymers soluble in or swellable with water or alkalescent water are suitably used. Among these, (meth)acrylic resins having an unsaturated group such as allyl group or acryloyl group, or a benzyl group and a carboxyl group in the side chain are preferred in view of excellent balance among layer strength, sensitivity and developability.

As for the radical polymerizable compound and the binder polymer, those described in detail in JP-A-2001-133969, paragraphs [0036] to [0060] can be used.

The thermal negative-type photosensitive composition preferably contains additives (for example, a surfactant for enhancing the coatability) described in JP-A-2001-133969, paragraphs [0061] to [0068].

As for the production method of the polymerization layer and the plate-making method, the methods described in detail in JP-A-2001-133969 can be used.

<Acid-Crosslinking Layer>

Another suitable example of the thermal negative-type image recording layer is an acid-crosslinking type image recording layer (acid-crosslinking layer). The acid-crosslinking layer contains a light-to-heat conversion substance, a thermal acid generator, a compound of undergoing crosslinking (crosslinking agent) under the action of an acid, which is a curable compound, and an alkali-soluble polymer compound capable of reacting with the crosslinking agent in the presence of an acid. In the acid-crosslinking layer, the light-to-heat conversion substance converts the absorbed infrared light into heat, the heat causes the thermal acid generator to decompose and generate an acid, and the generated acid causes the crosslinking agent to react with the alkali-soluble polymer compound to cure.

Examples of the light-to-heat conversion substance include the same light-to-heat conversion substances as used for the polymerization layer.

Examples of the thermal acid generator include thermally decomposable compounds such as photoinitiator for photopolymerization, photodiscolorizer for dyes, and acid generator used for microresist or the like.

Examples of the crosslinking agent include aromatic compounds substituted by a hydroxymethyl group or an alkoxymethyl group; compounds having an N-hydroxymethyl group, an N-alkoxymethyl group or an N-acyloxymethyl group; and epoxy compounds.

Examples of the alkali-soluble polymer compound include novolak resins and polymers having a hydroxyaryl group in the side chain.

<Non-Processing Type>

Examples of the non-processing type photosensitive composition include a thermoplastic fine particle polymer type, a microcapsule type and a type containing a sulfonic acid-generating polymer. These all are a heat-sensitive type containing a light-to-heat conversion substance. Preferred examples of the light-to-heat conversion substance include the same dyes as described above for use in the thermal positive type.

The thermoplastic fine particle polymer-type photosensitive composition is a composition where hydrophobic and heat-fusible polymer fine particles are dispersed in a hydrophilic polymer matrix. In the thermoplastic fine particle polymer-type image recording layer, the hydrophobic polymer fine particles are fused due to heat generated on exposure and melt-bonded to each other to form a hydrophobic region, namely, an image area.

The fine particle polymer is preferably a fine particle polymer which undergoes melt-fusing of fine particles with each other due to heat, more preferably a fine particle polymer of which surface is hydrophilic and which can be dispersed in a hydrophilic component such as fountain solution. Specific suitable examples thereof include the thermoplastic fine particle polymers described in *Research Disclosure*, No. 33303 (January, 1992), JP-A-9-123387, JP-A-9-131850, JP-A-9-171249, JP-A-9-171250 and EP-A-931,647. Among these, polystyrene and polymethyl methacrylate are preferred. Examples of the fine particle polymer having a hydrophilic surface include a polymer which is hydrophilic by itself; and a fine particle polymer on which surface a hydrophilic compound such as polyvinyl alcohol and polyethylene glycol is adsorbed to render the surface hydrophilic.

The fine particle polymer preferably has a reactive functional group.

Suitable examples of the microcapsule-type photo-sensitive composition include those described in JP-A-2000-118160, and microcapsules enclosing a compound having a heat-reactive functional group described in JP-A-2001-277740.

Examples of the sulfonic acid-generating polymer for use in the sulfonic acid-generating polymer-containing type photosensitive composition include polymers having a sulfonic acid ester group, a disulfone group or a sec- or tert-sulfonamide group in the side chain described in JP-A-10-282672.

When a hydrophilic resin is incorporated into the non-processing type photosensitive composition, not only good on-press developability is obtained but also the strength of the photosensitive layer itself is enhanced. Preferred examples of the hydrophilic resin include those having a hydrophilic group such as hydroxy group, carboxy group, hydroxyethyl group, hydroxypropyl group, amino group, aminoethyl group, aminopropyl group and carboxymethyl group, and hydrophilic sol-gel conversion-type binder resins.

The non-processing type image recording layer requires no particular development step and can be developed on a press. As for the production method of the non-processing type image recording layer and the plate-making printing method, the methods described in detail in JP-A-2002-178655 can be used.

<Overcoat Layer>

In the lithographic printing plate precursor of the present invention, a water-soluble overcoat layer can be provided on the image recording layer so as to prevent the surface of the image recording layer from contamination by lipophilic substances. The water-soluble overcoat layer which can be used in the present invention is preferably removable with ease at the printing and contains a resin selected from water-soluble organic polymer compounds.

The water-soluble organic polymer compound provides, after coating and drying, a coating having a film-forming capability. Specific examples thereof include a polyvinyl acetate (but having a hydrolysis percentage of 65% or more), a polyacrylic acid and an alkali metal salt or amine salt thereof, an acrylic acid copolymer and an alkali metal salt or amine salt thereof, a polymethacrylic acid and an alkali metal salt or amine salt thereof, a methacrylic acid copolymer and an alkali metal salt or amine salt thereof, a polyacrylamide and a copolymer thereof, a polyhydroxyethyl acrylate, a polyvinylpyrrolidone and a copolymer thereof, a polyvinyl methyl ether, a polyvinyl methyl ether/maleic anhydride copolymer, a poly-2-acrylamido-2-methyl-1-propanesulfonic acid and an alkali metal salt or amine salt thereof, a 2-acrylamido-2-methyl-1-propanesulfonic acid copolymer and an alkali metal salt or amine salt thereof, gum arabic, a cellulose derivative (e.g., carboxymethyl cellulose, carboxyethyl cellulose, methyl cellulose) and a modified product thereof, a white dextrin, a pullulan, and an enzyme-decomposed etherified dextrin. These resins may be used in combination of two or more thereof according to the use end.

Also, in the overcoat layer, a water-soluble light-to-heat converting agent out of those described above may be added. Furthermore, in the case where the overcoat layer is coated in the form of an aqueous solution, a nonionic surfactant such as polyoxyethylene nonylphenyl ether and polyoxyethylene dodecyl ether may be added for the purpose of ensuring uniformity of the coating.

The dry coated amount of the overcoat layer is preferably from 0.1 to 2.0 g/m$^2$. When the dry coated amount is in such a range, the surface of the image recording layer can be satisfactorily prevented from contamination by a lipophilic substance, such as attachment of fingerprint, without impairing the on-press developability.

<Backcoat>

On the back surface of the lithographic printing plate precursor of the present invention obtained in such a way by providing an image recording layer of various types on the lithographic printing plate support of the present invention, a coating layer comprising an organic polymer compound may be provided, if desired, so as to prevent scratching of the image recording layer when piled.

<Production Method of Lithographic Printing Plate Precursor>

Each layer such as the image recording layer is provided by dissolving the above-descried components in a solvent and coating the resulting coating solution on the lithographic printing plate support, whereby the lithographic printing plate precursor can be produced.

Examples of the solvent used here include ethylene dichloride, cyclohexanone, methyl ethyl ketone, methanol, ethanol, propanol, ethylene glycol monomethyl ether, 1-methoxy-2-propanol, 2-methoxyethyl acetate, 1-methoxy-2-propyl acetate, dimethoxyethane, methyl lactate, ethyl lactate, N,N-dimethylacetamide, N, N-dimethylformamide, tetramethylurea, N-methylpyrrolidone, dimethyl sulfoxide, sulfolane, γ-butyrolactone, toluene and water, however, the present invention is not limited thereto. These solvents can be used individually or as a mixture thereof.

The component (total solid content) concentration in the solvent is preferably from 1 to 50 wt %.

As the coating method, various methods may be used and examples thereof include bar coater coating, spin coating, spray coating, curtain coating, dip coating, air knife coating, blade coating and roll coating.

<Plate-Making Method (Production Method of Lithographic Printing Plate)>

The lithographic printing plate precursor using the lithographic printing plate support of the present invention is subjected to various treatments depending on the image recording layer to produce a lithographic printing plate.

Examples of the light source of emitting actinic light for use in the imagewise exposure include mercury lamp, metal halide lamp, xenon lamp and chemical lamp. Examples of the light source of emitting laser beam include helium-neon laser (He—Ne laser), argon laser, krypton laser, helium-cadmium laser, KrF excimer laser, semiconductor laser, YAG laser and YAG-SHG laser.

In the case where the image recording layer is thermal positive type or thermal negative type, the image recording layer after exposure is preferably developed with a developer to obtain a lithographic printing plate.

The developer is preferably an alkali developer, more preferably an alkaline aqueous solution containing substantially no organic solvent.

A developer containing substantially no alkali metal silicate and containing a sugar (a developer containing substantially no alkali metal silicate) is also preferred. The development with a developer containing substantially no alkali metal silicate can be performed by the method described in detail in JP-A-11-109637.

Also, a developer containing an alkali metal silicate may be used.

When the lithographic printing plate precursor is processed by the method of performing the development with a developer containing substantially no alkali metal silicate, the problems encountered in the development with a developer containing an alkali metal silicate, for example, in that solid matters ascribable to $SiO_2$ are liable to precipitate and in that a gel ascribable to $SiO_2$ is produced in the neutralization at the time of treating the waste solution of the developer, can be prevented.

The lithographic printing plate precursor of the present invention is obtained by providing the image recording layer on the lithographic printing plate support strong in the film strength and excellent in the scratch resistance and heat insulating property of the present invention where a porous layer is provided, so that excellent sensitivity can be obtained and the lithographic printing plate produced can have excellent staining resistance and press life. Furthermore, the lithographic printing plate support, lithographic printing plate precursor and lithographic printing plate of the present invention can be reduced in the production cost.

The present invention is described in greater detail below by referring to Examples, however, the present invention is not limited thereto.

EXAMPLE 1

1. Production of Lithographic Printing Plate Support

<Preparation of Coating Solution for Porous Layer>

Coating Solutions C-1 to C-14 each having the composition shown in Table 1 were prepared by the following method.

That is, 0.1 g of citric acid as the dispersant was charged in an appropriate amount of water and after stirring for a while, the metal oxide shown in Table 1 was added according to the Amount Used (g) shown in Table 1. The metal oxide was then uniformly dispersed for about 10 minutes by using an ultrasonic dispersing apparatus (Ultrasonic Homogenizer, VC-130, manufactured by SONICS) and a homogenizer (Auto Cell Master CM-200, manufactured by AS ONE Corporation).

Thereafter, the phosphoric acid-base compound and reaction accelerator shown in Table 1 were added each according to the Amount Used shown in Table 1 and water was further charged thereinto to adjust the weight of the entire coating solution to 100 g, thereby obtaining Coating Solutions C-1 to C-14.

For the metal oxide shown in Table 2, a commercial product was used as it is or after adjusting the average particle size by grinding.

More specifically, "MgO" used in the Coating Solutions C-1 and C-2 was Ube Materials 2000A (average particle size: 0.2 μm, produced by Ube Industries, Ltd.).

"$SiO_2$" used in Coating Solutions C-3 to C-6 was TOWANALITE FTB (average particle size: 12 μm, produced by Towana, shirasu balloon) which was ground by the method described below to adjust the average particle size of the metal oxide after the grinding to 0.3 μm.

"$ZrO_2$" used in Coating Solutions C-7 and C-8 was NANOTEC Series (common name: ultrafine particle) $ZrO_2$ (average particle size: 0.03 μm, produced by C.I. Kasei Co., Ltd.).

"$SiO_2/Al_2O_3$" used in Coating Solutions C-9 and C-10 was NANOTEC Series (common name: ultrafine particle) $SiO_2/Al_2O_3$ (a mixed oxide having an average particle size of 0.03 μm, produced by C.I. Kasei Co., Ltd.).

"$MgO/Al_2O_3$" used in Coating Solutions C-11 and C-12 was NANOTEC Series (common name: ultrafine particle) $MgO/Al_2O_3$ (a mixed oxide having an average particle size of 0.05 μm, produced by C.I. Kasei Co., Ltd.).

"$3Al_2O_3.2SiO_2$" used in Coating Solutions C-13 and C-14 was mullite (powder) (composite oxide, average particle size: 0.8 μm, produced by KCM Corporation) which was ground to adjust the average particle size of the composite oxide after the grinding to 0.3 μm.

The phosphoric acid, sodium dihydrogenphosphate ($NaH_2PO_4$), citric acid, sodium fluoride, zirconium phosphate, aluminum phosphate and aluminum chloride used all were reagents produced by Kanto Kagaku.

The above-described $SiO_2$ and $3Al_2O_3.2SiO_2$ each was ground by using a mill such as HD A-5 Pot Mill (YTZ-0.2, manufactured by Nikkato Corporation) and the average particle size was adjusted by changing the grinding time in the range from 1 to 100 hours at a rotation number of about 100 rpm.

The amount used of the metal oxide in each coating solution was adjusted by calculating the amount of giving a constant reaction amount with the phosphoric acid-base compound (namely, amount produced of the compound containing a metal oxide and a phosphoric atom) according to the following formula.

Assuming that the average particle radius of the MgO particle in Coating Solution C-1 is $r_1$, the density is $d_1$ and the weight is $W_1$ and that the average particle radius of the metal oxide particle in Coating Solutions C-3 to C-14 is $r_2$, the density is $d_2$ and the weight is $W_2$, the amount used of the metal oxide particle in Coating Solutions C-3 to C-14 was calculated by the following formula:

$$W_2=[(r_2\times d_2)/(r_1\times d_1)]\times W_1$$

Also, the amount used of the phosphoric acid-base compound is adjusted to give a constant molar number of acidic proton (molar number used of the phosphorus-base compound×valence number) in Coating Solutions C-4 and C-6 to C-14 and the amount used was changed to the amount shown in Table 1 in Coating Solutions C-3 and C-5.

TABLE 1

| | Metal Oxide | | Phosphoric Acid-Base Compound | | | Reaction Accelerator | |
|---|---|---|---|---|---|---|---|
| Coating Solution | Kind | Amount Used (g) | Kind | Amount Used (g) | Dispersant (g) | Kind | Amount Used (g) |
| C-1 | MgO | 26 | $H_3PO_4$ | 5.5 | 0.1 | zirconium phosphate | 1 |
| C-2 | MgO | 26 | $NaH_2PO_4$ | 8.8 | 0.1 | zirconium phosphate | 1 |

TABLE 1-continued

| Coating Solution | Metal Oxide Kind | Metal Oxide Amount Used (g) | Phosphoric Acid-Base Compound Kind | Phosphoric Acid-Base Compound Amount Used (g) | Dispersant (g) | Reaction Accelerator Kind | Reaction Accelerator Amount Used (g) |
|---|---|---|---|---|---|---|---|
| C-3 | $SiO_2$ | 44 | $H_3PO_4$ | 2.0 | 0.1 | sodium fluoride | 1 |
| C-4 | $SiO_2$ | 44 | $H_3PO_4$ | 5.5 | 0.1 | sodium fluoride | 1 |
| C-5 | $SiO_2$ | 44 | $H_3PO_4$ | 7.0 | 0.1 | sodium fluoride | 1 |
| C-6 | $SiO_2$ | 44 | $NaH_2PO_4$ | 8.8 | 0.1 | sodium fluoride | 1 |
| C-7 | $ZrO_2$ | 6.8 | $H_3PO_4$ | 5.5 | 0.1 | aluminum phosphate | 1 |
| C-8 | $ZrO_2$ | 6.8 | $NaH_2PO_4$ | 8.8 | 0.1 | aluminum phosphate | 1 |
| C-9 | $SiO_2/Al_2O_2$ | 7.3 | $H_3PO_4$ | 5.5 | 0.1 | aluminum chloride | 4 |
| C-10 | $SiO_2/Al_2O_2$ | 7.3 | $NaH_2PO_4$ | 8.8 | 0.1 | aluminum chloride | 4 |
| C-11 | $MgO/Al_2O_3$ | 7.3 | $H_3PO_4$ | 5.5 | 0.1 | aluminum chloride | 4 |
| C-12 | $MgO/Al_2O_3$ | 7.3 | $NaH_2PO_4$ | 8.8 | 0.1 | aluminum chloride | 4 |
| C-13 | $3Al_2O_3 \cdot 2SiO_2$ | 44 | $H_3PO_4$ | 5.5 | 0.1 | aluminum chloride | 4 |
| C-14 | $3Al_2O_3 \cdot 2SiO_2$ | 44 | $NaH_2PO_4$ | 8.8 | 0.1 | aluminum chloride | 4 |

<Production of Substrate>

<Aluminum Substrate AL-1>

A 0.24 mm-thick aluminum plate (JIS1050 material (produced by Sumitomo Light Metal Industries, Ltd.)) was subjected to an alkali degreasing treatment. Specifically, the aluminum plate was dipped in an aqueous sodium hydroxide solution (concentration: 26%) at a liquid temperature of 70° C. for 10 seconds, then washed with water, further dipped in a sulfuric acid (concentration: 36%) at a liquid temperature of 60° C. for 60 seconds, washed with water to obtain Aluminum Substrate AL-1.

(Stainless Steel Substrates SUS1 to SUS3)

Stainless Steel Substrate SUS1 was obtained by subjecting a 0.24 mm-thick stainless steel (SUS304 material (produced by Nippon Yakin Kogyo Co., Ltd.)) to sputtering under Condition 1 shown below by using a sputtering apparatus (Model SRV4310, manufactured by Shinko Seiki Co., Ltd.) to provide an $SiO_2$ thin layer having a layer thickness of 50 nm.

Stainless Steel Substrate SUS2 was obtained in the same manner as above except that the sputtering was performed under Condition 2 to provide an MgO thin layer having a layer thickness of 50 nm.

Stainless Steel Substrate SUS3 was obtained in the same manner as above except that the sputtering was performed under Condition 3 to provide a ZrO thin layer having a layer thickness of 50 nm.

(Condition 1)

Ultimate pressure: $5\times10^{-4}$ Pa, sputtering pressure: $6.7\times10^{-1}$ Pa, argon flow rate: 20 sccm, no heating and no cooling of substrate, no bias, sputtering power source: RF, sputtering power: 0.5 kW, pre-sputtering time: 5 minutes, sputtering time: 5 minutes, no reactive sputtering, no reverse sputtering, target: $SiO_2$.

(Condition 2)

Ultimate pressure: $5\times10^{-4}$ Pa, sputtering pressure: $6.7\times10^{-1}$ Pa, argon flow rate: 20 sccm, no heating and no cooling of substrate, no bias, sputtering power source: RF, sputtering power: 1.0 kW, pre-sputtering time: 5 minutes, sputtering time: 10 minutes, reactive sputtering oxygen: $1\times10^{-3}$ Pa, no reverse sputtering, target: MgO.

(Condition 3)

Ultimate pressure: $5\times10^{-4}$ Pa, sputtering pressure: $6.7\times10^{-1}$ Pa, argon flow rate: 20 sccm, no heating and no cooling of substrate, no bias, sputtering power source: RF, sputtering power: 2.0 kW, pre-sputtering time: 5 minutes, sputtering time: 6 minutes, no reactive sputtering, no reverse sputtering, target: ZrO.

The thickness of the thin layer provided by the sputtering was adjusted to a desired value by controlling the sputtering time based on the correlation calibration curve between the sputtering time and the layer thickness obtained by measuring the thickness of each layer through an atomic force microscope (AFM).

<Production of Lithographic Printing Plate Support>

Using a combination of a substrate and a coating solution shown in Table 2, the coating solution was coated on the substrate by a commercially available wire bar to have a dry layer thickness shown in Table 2 and dried at a drying temperature shown in Tale 2 to form a porous layer.

In Examples 1-6 and 1-7 of the invention, the formation of the porous layer was repeated two times and three times, respectively, to form a porous layer having a two-layer structure or a three-layer structure. The layers superposed each had almost the same thickness.

The thickness of the porous layer was adjusted by selecting the wire size of giving a desired layer thickness from commercially available wire bars varied in the wire size from #1.6 (coated amount: about 3 ml/m$^2$) to #28 (coated amount: about 53 ml/m$^2$).

The drying time which varies depending on the thickness (μm) of the porous layer was set to, as a standard, a drying time calculated from 30 seconds+20 seconds×(layer thickness−1). Specifically, when the layer thickness was 5.5 μm, the drying time was 30+20×(5.5−1)=120 seconds.

On the porous layer formed above, a coating solution for the pore-sealing layer having the following composition was coated by a commercially available wire bar to have a dry layer thickness shown in Table 2 and dried (at a temperature of 120° C. for 2 minutes) to form a pore-sealing layer, thereby obtaining a lithographic printing plate support of the present invention.

In Example 1-1 of the invention and Comparative Example 1-1, the porous layer was not formed.

(Composition of Coating Solution for Pore-Sealing Layer)

| | |
|---|---|
| #3 Sodium silicate (reagent produced by Kanto Kagaku) as silicate | 10 g |
| ALMATEX E269 (emulsion resin, produced by Mitsui Chemicals, Inc.) as hydrophilic resin | 0.4 g |
| Water | 50 g |

COMPARATIVE EXAMPLES 1-1 TO 1-3

<Production of Lithographic Printing Plate Support>

Using Aluminum Substrate AL-1 which had been subjected to the degreasing treatment in the same manner as in Examples of the invention without surface-roughening, an anodic oxide film was formed directly on Aluminum Substrate AL-1 by the following method.

That is, an aqueous sulfuric acid solution having a sulfuric acid concentration of 15 wt % (containing 0.5 wt % of aluminum ion) at a temperature of 38° C. was used as the electrolytic solution and a continuous d.c. electrolysis was performed to have a final oxide film amount (layer thickness amount) shown in Table 2.

For the formation of the anodic oxide film, a coating solution was not used and therefore, the columns of "Coating Solution" and "Drying Temperature" in Table 2 are shown by "-". Also, the thickness of the anodic oxide film is shown in the column of "Thickness of Porous Layer" in Table 2. The thickness of the anodic oxide film was measured by a commonly employed method. The porosity of the anodic oxide film was not measured and shown by "-" in the column of "Porosity of Porous Layer" in Table 2.

2. Evaluation of Porous Layer and Pore-Sealing Layer

<Porosity of Porous Layer>

The porosity of the porous layer was determined from the thickness of the porous layer shown in Table 2 and the weight of the porous layer after drying.

Specifically, the density was calculated from the thickness of the porous layer and the weight of the film per unit area according to the following formula:

$$\text{Density (g/cm}^3\text{)}=(\text{weight of film per unit area/layer thickness})$$

Using the calculated density, the porosity was determined according to the following formula:

$$\text{Porosity (\%)}=\{1-(\text{density of porous layer}/D)\}\times 100$$

wherein D is a density (g/cm$^2$) of the metal oxide used for the formation of the porous layer, which is known in *Kagaku Binran* (*Handbook of Chemistry*).

The weight of the film per unit area of the porous layer was determined by a method commonly known as the Maison method. The thickness of the porous layer shown in Table 2 is a value measured by the observation through an ultrahigh-resolution scanning electron microscope at the following magnification depending on the layer thickness.

The magnification was 10,000 times when the layer thickness was 1 μm or less, the magnification was 3,000 times when the layer thickness was from 1 to 5 μm, and the magnification was from 100 to 3,000 times when the layer thickness was 5 μm or more.

<Porosity of Pore-Sealing Layer>

In the measurement of the porosity of the pore-sealing layer, the lithographic printing plate supports obtained in Examples 1-2 to 1-25 of the invention each was bent to produce a broken face and the broken face was observed and photographed by an ultrahigh-resolution scanning electron microscope (S-900, manufactured by Hitachi Ltd.) at a magnification of 50,000 times. In the 3 cm×3 cm range of the obtained image data (photograph), a void portion was not observed in all lithographic printing plate supports and therefore, the porosity is shown as "0%" in Table 2.

In Comparative Examples 1-2 and 1-3, the porosity of the pore-sealing layer was not observed and shown by "-" in the column of "Porosity of Pore-Sealing Layer" in Table 2.

<Scratch Resistance>

The porous layer or anodic oxide film of each lithographic printing plate support obtained in Examples 1-1 to 1-25 of the invention and Comparative Examples 1-1 to 1-3 was evaluated on the scratch resistance by the following method. The results obtained are shown in Table 2.

That is, the porous layer or anodic oxide film of those Examples of the invention and Comparative Examples was subjected to a scratch test and evaluated.

The scratch test was performed by using a continuous load applying scratch tester SB62 TYPE18 (manufactured by Shinto Scientific Co., Ltd.) under the conditions of a sapphire needle of 0.4 mmϕ and a needle moving rate of 10 cm/sec while sequentially changing the applied load to 10 g, 20 g, 25 g, 30 g, 50 g, 80 g, 100 g and 150 g. The evaluation was performed by the value of load applied when a scratch was visually observed on the porous layer or anodic oxide film.

The rating was "AA" when the value of load applied was 50 g or more, "A" when 30 g, "B" when 25 g, "C" when 20 g, and "E" when 10 g.

2. Production of Lithographic Printing Plate Precursor

On each of the lithographic printing plate supports obtained in Examples 1-1 to 1-25 of the invention and Comparative Examples 1-1 to 1-3, a photosensitive coating solution having the following composition was coated to have a dry film amount of 1.0 g/m$^2$ and then dried at 140° C. for 50 seconds in PERFECT OVEN PH200 manufactured by TABAI by setting Wind Control to 7.

(Composition of Photosensitive Coating Solution)

| | |
|---|---|
| m,p-Cresol novolak (m/p ratio = 6/4, weight average molecular weight: 3,500, containing 0.5 wt % of unreacted cresol) | 0.427 g |
| Siloxane Structure-Containing Alkali-Soluble Resin (F-1) obtained by the synthesis method shown below | 0.047 g |
| Specific Copolymer 1 described in JP-A-11-288093 | 2.37 g |
| Cyanine Dye A shown below | 0.155 g |

-continued

| | |
|---|---|
| 2-Methoxy-4-(N-phenylamino) benzene | 0.03 g |
| Diazonium hexafluorophosphate tetrahydrophthalic anhydride | 0.19 g |
| Compound where counter ion of Ethyl Violet was changed to 6-hydroxy-(β-naphthalenesulfonate | 0.05 g |
| Fluorine-containing surfactant (Megafac F-176PF, produced by Dainippon Ink & Chemicals, Inc.) | 0.035 g |
| Fluorine-containing surfactant (Megafac MCF-312, produced by Dainippon Ink & Chemicals, Inc.) | 0.05 g |
| p-Toluenesulfonic acid | 0.008 g |
| Bis-p-hydroxyphenylsulfone | 0.063 g |
| n-Dodecyl stearate | 0.06 g |
| γ-Butyrolactone | 13 g |
| Methyl ethyl ketone | 24 g |
| 1-Methoxy-2-propanol | 11 g |

(Synthesis of Siloxane Structure-Containing Alkali-Soluble Resin (F-1))

In 400 mL of methanol, 120 g of cresol novolak (m/p ratio=6/4, weight average molecular weight=5,200) was dissolved and thereto, 5.4 g of sodium methoxide was added. The resulting solution was stirred for 30 minutes and after distilling out the methanol under reduced pressure, 400 mL of tetrahydrofuran was added to displace the solvent. Thereto, 17 g of epoxy-type terminal reactive silicone MCR-E11 (produced by Chisso Corporation) was added and the solution was refluxed under heat for 6 hours. The reaction solution was cooled to room temperature and poured into 8,000 mL of water and the separated matter was collected by filtration, washed with water and dried to obtain 132 g of Siloxane Structure-Containing Alkali-Soluble Resin (F-1).

Cyanine Dye A:

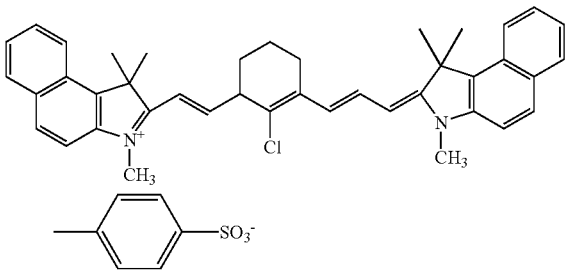

3. Evaluation of Lithographic Printing Plate Precursor and Lithographic Printing Plate <Measurement of Clear Sensitivity>

The lithographic printing plate precursors obtained above each was exposed by using Trend Setter 3244VFS manufactured by Creo Co. equipped with a water-cooled 40 W infrared semiconductor laser and outputting it under the condition of a resolution of 2,400 dpi. At this time, the plate surface energy was varied by changing the rotation number of the outer drum for the evaluation of sensitivity.

After the image exposure, the lithographic printing plate precursors were developed by using PS Processor 900H manufactured by Fuji Photo Film Co., Ltd. having charged therein Developer DT-1 (diluted at 1:8) produced by Fuji Photo Film Co., Ltd. and Finisher FP2W (diluted at 1:1) produced by Fuji Photo Film Co., Ltd., at a liquid temperature of 30° C. for a development time of 12 seconds (the electrical conductivity of the developer was 45 mS/cm)

The sensitivity was evaluated by the minimum exposure amount when scumming or coloration ascribable to the remaining of the image recording layer due to development failure was not observed and satisfactory development was attained, and the exposure amount is shown in Table 2.

The smaller exposure amount reveals more excellent sensitivity of the lithographic printing plate precursor.

<Staining Resistance>

The lithographic printing plate precursor obtained above was subjected to imagewise drawing by using Trend Setter manufactured by Creo Co. at a drum rotation speed of 150 rpm and a beam intensity of 10 W.

Using a lithographic printing plate obtained after developing the lithographic printing plate precursor in the same manner as in the evaluation of the clear sensitivity, printing was performed with an ink of DIC-GEOS(s) Rouge in Mitsubishi Dia Model F2 Press (manufactured by Mitsubishi Heavy Industries, Ltd.). After printing 50 sheets, the press was once stopped and the ink in the blanket portion of the press was transferred to a PET tape produced by Nitto Denko Corporation. The staining with ink in the non-image area on the PET tape was visually evaluated according to the following criteria. The results are shown in Table 2.

The rating was "AA" when the generation of staining was not confirmed at all, "A" when the generation of staining was scarcely confirmed, "B" when the generation of staining was slightly confirmed, "D" when staining was seriously generated, and "E" when staining was generated throughout the non-image area.

<Press Life>

Using the lithographic printing plate obtained in the same manner as in the evaluation of <Staining Resistance>, the number of sheets of giving a printed matter free of residual color, residual layer and staining was counted under the same printing conditions. That is, the printing was finished when any one of residual color, residual layer and staining became lower than the allowable level as the printed matter, and the number of sheets at that time was designated as the number of printed sheets.

As a result, in all Examples of the invention, the number of printed sheet was equal to or greater than the number of printed sheets in Comparative Examples, revealing that the lithographic printing plates in Examples of the invention had excellent press life equal to or longer than that of the lithographic printing plates in Comparative Examples.

TABLE 2

| | Substrate | Coating Solution | Drying Temperature (° C.) | Thickness of Porous Layer (μm) | Porosity of Porous Layer (%) | Thickness of Pore-Sealing Layer (μm) | Porosity of Pore-Sealing Layer (%) | Scratch Resistance | Sensitivity (mJ/cm$^2$) | Staining Resistance |
|---|---|---|---|---|---|---|---|---|---|---|
| Example 1-1 | AL-1 | C-1 | 180 | 5.5 | 50 | 0 | — | A | 380 | B |
| Example 1-2 | AL-1 | C-1 | 180 | 5.5 | 50 | 0.01 | 0 | A | 200 | B |

TABLE 2-continued

| | Substrate | Coating Solution | Drying Temperature (° C.) | Thickness of Porous Layer (μm) | Porosity of Porous Layer (%) | Thickness of Pore-Sealing Layer (μm) | Porosity of Pore-Sealing Layer (%) | Scratch Resistance | Sensitivity (mJ/cm$^2$) | Staining Resistance |
|---|---|---|---|---|---|---|---|---|---|---|
| Example 1-3 | AL-1 | C-1 | 180 | 5.5 | 50 | 0.1 | 0 | A | 200 | A |
| Example 1-4 | AL-1 | C-1 | 180 | 5.5 | 50 | 0.3 | 0 | A | 200 | A |
| Example 1-5 | AL-1 | C-1 | 180 | 5.5 | 50 | 0.5 | 0 | A | 230 | A |
| Example 1-6 | AL-1 | C-1 | 180 | 12 (2-layer) | 50 | 0.2 | 0 | AA | 150 | A |
| Example 1-7 | AL-1 | C-1 | 180 | 20 (3-layer) | 50 | 0.2 | 0 | AA | 150 | A |
| Example 1-8 | AL-1 | C-1 | 180 | 0.8 | 50 | 0.2 | 0 | C | 320 | AA |
| Example 1-9 | AL-1 | C-2 | 180 | 0.8 | 50 | 0.2 | 0 | C | 320 | AA |
| Example 1-10 | AL-1 | C-5 | 180 | 6.0 | 50 | 0.1 | 0 | B | 190 | A |
| Example 1-11 | SUS1 | C-4 | 260 | 5.5 | 50 | 0.2 | 0 | A | 200 | AA |
| Example 1-12 | SUS1 | C-6 | 260 | 5.5 | 50 | 0.2 | 0 | A | 200 | AA |
| Example 1-13 | SUS1 | C-1 | 260 | 5.5 | 50 | 0.2 | 0 | C | 200 | B |
| Example 1-14 | SUS1 | C-2 | 260 | 5.5 | 50 | 0.2 | 0 | C | 200 | B |
| Example 1-15 | SUS1 | C-7 | 260 | 5.5 | 50 | 0.2 | 0 | A | 200 | B |
| Example 1-16 | SUS1 | C-8 | 260 | 5.5 | 50 | 0.2 | 0 | A | 200 | B |
| Example 1-17 | AL-1 | C-9 | 180 | 5.5 | 50 | 0.2 | 0 | C | 380 | AA |
| Example 1-18 | AL-1 | C-10 | 180 | 5.5 | 20 | 0.2 | 0 | C | 380 | AA |
| Example 1-19 | AL-1 | C-11 | 180 | 5.5 | 20 | 0.2 | 0 | C | 380 | AA |
| Example 1-20 | AL-1 | C-12 | 180 | 5.5 | 20 | 0.2 | 0 | C | 380 | AA |
| Example 1-21 | AL-1 | C-13 | 180 | 5.5 | 20 | 0.2 | 0 | A | 200 | AA |
| Example 1-22 | AL-1 | C-14 | 180 | 5.5 | 20 | 0.2 | 0 | A | 200 | AA |
| Example 1-23 | SUS1 | C-3 | 260 | 5.0 | 50 | 0.1 | 0 | B | 210 | A |
| Example 1-24 | SUS1 | C-4 | 260 | 5.5 | 50 | 0.1 | 0 | A | 200 | A |
| Example 1-25 | SUS1 | C-5 | 260 | 6.0 | 50 | 0.1 | 0 | A | 190 | A |
| Comparative Example 1-1 | AL-1 | — | — | 5.5 | — | 0 | — | A | 400 | D |
| Comparative Example 1-2 | AL-1 | — | — | 5.5 | — | 0.2 | — | A | 380 | A |
| Comparative Example 1-3 | AL-1 | — | — | 0.8 | — | 0.2 | — | C | 450 | A |

As apparent from Table 2, the porous layer of the present invention has a film strength equal to the anodic oxide film. Also, the lithographic printing plate precursor produced from a lithographic printing plate support where the porous layer is provided, preferably a pore-sealing layer is further provided on the porous layer, has excellent sensitivity equal to or higher than that of the lithographic printing plate precursor produced from a lithographic printing plate support where an anodic oxide film is provided. Furthermore, the lithographic printing plate support where the porous layer is provided, preferably a pore-sealing layer is further provided on the porous layer, ensures excellent staining resistance and press life when a lithographic printing plate is produced.

The porous layer can be formed at a relatively low temperature (less than the temperature of causing softening of aluminum) and therefore, even when an aluminum substrate is used as the substrate, the printing performance is prevented from reduction (particularly, misregistering between the substrate and the image) due to softening of the aluminum substrate.

In addition, the lithographic printing plate support of the present invention where the porous layer is provided is excellent in all of the scratch resistance, sensitivity, staining resistance and press life even when produced by using various substrates.

EXAMPLE 2

1. Preparation of Coating Solution for Porous Layer

Coating Solutions C-1 to C-8 each having the composition shown in Table 3 were prepared by the following method.

That is, 0.1 g of citric acid as the dispersant was charged in an appropriate amount of water and after stirring for a while, the metal oxide shown in Table 3 was added according to the Amount Used (g) shown in Table 3. The metal oxide was then uniformly dispersed for about 10 minutes by using an ultrasonic dispersing apparatus (Ultrasonic Homogenizer, VC-130, manufactured by SONICS) and a homogenizer (Auto Cell Master CM-200, manufactured by AS ONE Corporation).

Thereafter, the phosphoric acid-base compound and reaction accelerator shown in Table 3 were added each according to the Amount Used shown in Table 3 and water was further charged thereinto to adjust the weight of the entire coating solution to 100 g, thereby obtaining Coating Solutions C-1 to C-8.

For the metal oxide shown in Table 4, a commercial product was used as it is or after adjusting the average particle size by grinding.

More specifically, "$Al_2O_3$" used in Coating Solution C-1 was AKP-50 (average particle size: 0.3 μm, produced by Sumitomo Chemical Co., Ltd.).

"MgO" used in the Coating Solution C-2 was Ube Materials 2000A (average particle size: 0.2 μm, produced by Ube Industries, Ltd.).

"$ZrO_2$" used in Coating Solution C-3 was NANOTEC Series (common name: ultrafine particle) $ZrO_2$ (average particle size: 0.03 μm, produced by C.I. Kasei Co., Ltd.).

"$SiO_2$" used in Coating Solution C-4 was TOWANALITE FTB (average particle size: 12 μm, produced by Towana, shirasu balloon) which was ground by the method described below to adjust the average particle size of the metal oxide after the grinding to 0.3 μm.

"$SiO_2/Al_2O_3$" used in Coating Solution C-5 was NANOTEC Series (common name: ultrafine particle) $SiO_2/Al_2O_3$ (a mixed oxide having an average particle size of 0.03 μm, produced by C.I. Kasei Co., Ltd.).

"$MgO/Al_2O_3$" used in Coating Solution C-6 was NANOTEC Series (common name: ultrafine particle) $MgO/Al_2O_3$ (a mixed oxide having an average particle size of 0.05 μm, produced by C.I. Kasei Co., Ltd.).

"$3Al_2O_3.2SiO_2$" used in Coating Solution C-7 was mullite (powder) (composite oxide, average particle size: 0.8 μm, produced by KCM Corporation) which was ground by the method described below to adjust the average particle size of the mixed oxide after the grinding to 0.3 μm.

"$TiO_2$" used in Coating Solution C-8 was ANATASE $TiO_2$ (trade name, average particle size: 0.05 μm, reagent produced by Wako Pure Chemical Industries, Ltd., amorphous).

The phosphoric acid, citric acid, sodium fluoride (NaF), zirconium phosphate, aluminum phosphate and aluminum chloride used all were reagents produced by Kanto Kagaku.

The above-described $SiO_2$ and $3Al_2O_3.2SiO_2$ each was ground by using a mill such as HD A-5 Pot Mill (YTZ-0.2, manufactured by Nikkato Corporation) and the average particle size was adjusted by changing the grinding time in the range from 1 to 100 hours at a rotation number of about 100 rpm.

The amount used of the metal oxide in each coating solution was adjusted by calculating the amount of giving a constant reaction amount with the phosphoric acid-base compound (namely, amount produced of the compound containing a metal oxide and a phosphoric atom) according to the following formula.

Assuming that the average particle radius of the $Al_2O_3$ particle in Coating Solution C-1 is $r_1$, the density is $d_1$ and the weight is $W_1$ and that the average particle radius of the metal oxide particle in Coating Solutions C-2 to C-8 is $r_2$, the density is $d_2$ and the weight is $W_2$, the amount used of the metal oxide particle in Coating Solutions C-2 to C-8 was calculated by the following formula:

$$W_2=[(r_2\times d_2)/(r_1\times d_1)]\times W_1$$

TABLE 3

| | Metal Oxide | | Phosphoric Acid-Base Compound | | | Reaction Accelerator | |
|---|---|---|---|---|---|---|---|
| Coating Solution | Kind | Amount Used (g) | Kind | Amount Used (g) | Dispersant (g) | Kind | Amount Used (g) |
| C-1 | $Al_2O_3$ | 44 | $H_3PO_4$ | 5.5 | 0.1 | $AlCl_3$ | 4 |
| C-2 | MgO | 26 | $H_3PO_4$ | 5.5 | 0.1 | zirconium phosphate | 1 |
| C-3 | $ZrO_2$ | 6.8 | $H_3PO_4$ | 5.5 | 0.1 | aluminum phosphate | 1 |
| C-4 | $SiO_2$ | 44 | $H_3PO_4$ | 5.5 | 0.1 | NaF | 1 |
| C-5 | $SiO_2/Al_2O_3$ | 7.3 | $H_3PO_4$ | 5.5 | 0.1 | $AlCl_3$ | 2 |
| C-6 | $MgO/Al_2O_3$ | 7.3 | $H_3PO_4$ | 5.5 | 0.1 | $AlCl_3$ | 2 |
| C-7 | $3Al_2O_3 \bullet 2SiO_2$ | 44 | $H_3PO_4$ | 5.5 | 0.1 | $AlCl_3$ | 4 |
| C-8 | $TiO_2$ | 7.3 | $H_3PO_4$ | 5.5 | 0.1 | $AlCl_3$ | 2 |

2. Production of Substrate

<Aluminum Substrate AL-1>

A 0.24 mm-thick aluminum plate (JIS1050 material (produced by Sumitomo Light Metal Industries, Ltd.)) was dipped in an aqueous sodium hydroxide solution (concentration: 26 wt %) at a liquid temperature of 70° C. for 10 seconds, then washed with water, further dipped in a sulfuric acid (concentration: 36%) at a liquid temperature of 60° C. for 60 seconds and washed with water to obtain Aluminum Substrate AL-1.

<Aluminum Substrate AL-2>

Using Aluminum Substrate AL-1 produced above, Aluminum Substrate AL-2 was produced by the following method.

In an apparatus schematically shown in FIG. 1, a mechanical surface-roughening treatment was performed by rotating rotary brushes while supplying a water suspension (specific gravity: 1.1 g/cm$^3$) of alumina powder (A-25, produced by Sumitomo Chemical Co., Ltd., median particle size: 50 μm) as the abrasive slurry to the surface of Substrate AL-1. In FIG. 1, 1 is a substrate, 2 and 4 are rotary brushes, 3 is an abrasive slurry solution, and 5, 6, 7 and 8 are supporting rollers.

The rotary brush is made of 6·10 nylon and a #18 nylon brush having a bristle diameter of 0.72 mm and a bristle length of 60 mm was embedded in holes punched in a ϕ400 mm stainless steel-made barrel.

In FIG. 1, only two rotary brushes are shown but in practice, four rotary brushes were used (first, second, third and fourth brushes sequentially from the upstream side in the conveyance direction of the substrate). The distance between surfaces of two supporting rollers (ϕ250 mm) under the brush was 300 mm.

The substrate was pressed by the rotary brushes until the load of the driving motor rotating the rotary brush was increased in all of first to fourth brushes by 2.5 kW from the load before pressing the rotary brush to the substrate. The rotation direction of the first and fourth rotary brushes was the same as the moving direction of the substrate and the rotation direction of the second and third brushes was reversed to the moving direction. The rotation number of the rotary brush was 300 rpm in all of the first to fourth brushes.

The lap angle between each brush and the substrate was about 30°.

The moving speed of the substrate was 75 m/min.

<Aluminum Substrate AL-3>

Using Aluminum Substrate AL-1, Aluminum Substrate AL-3 was produced by the following method.

Aluminum substrate AL-1 was continuously subjected to an electrochemical surface-roughening treatment using a direct current. At this time, the electrolytic solution was an aqueous 10.5 g/L nitric acid solution (containing 5 g/L of aluminum ion and 0.007 wt % of ammonium ion) and the liquid temperature was 50° C. The electrochemical surface-roughening treatment was performed by using a carbon electrode as the counter electrode. For the auxiliary anode, ferrite was used. The current density was 30 A/dm$^2$ as the peak value of current and the quantity of electricity at the anode time was 200 C/dm$^2$.

<Aluminum Substrate AL-4>

Using Aluminum Substrate AL-1, Aluminum Substrate AL-4 was produced by the following method.

The surface of an SUS steel-made roll was polished to a mirror finish having a maximum roughness of 0.03 μm and then worked with a YAG laser machining apparatus having a rated output of 10 W to form grooves each having a longitudinal width of 5 μm and a transverse width of 5 μm with a distance of 10 μm between grooves, thereby obtaining a transfer roller imparted with a plurality of independent 1 μm-square protruded portions. By using the transfer roller, the transfer was performed on Aluminum Substrate AL-1 under the conditions of linear pressing force: 10 kg/mm and number of transfers: one time. The area percentage of the recessed portion formed by the transfer was 28%.

<Aluminum Substrate AL-5>

A commercially available mirror-treated aluminum plate (mirror-finished material, XL (trade name, produced by Sumitomo Light Metal Industries, Ltd.), plate thickness: 0.3 μm, purity: 99.3%) was used.

<Stainless Steel Substrates SUS1 and SUS2)

Stainless Steel Substrate SUS2 was obtained by subjecting a 0.24 mm-thick stainless steel (SUS304 material (produced by Nippon Yakin Kogyo Co., Ltd.)) to sputtering under Condition 1 shown below by using a sputtering apparatus (Model SRV4310, manufactured by Shinko Seiki Co., Ltd.) to provide an $SiO_2$ thin layer having a layer thickness of 50 nm.

Stainless Steel Substrate SUS1 was obtained in the same manner as above except that the sputtering was performed under Condition 2 to provide a ZrO thin layer having a layer thickness of 50 nm.

(Condition 1)

Ultimate pressure: $5\times10^{-4}$ Pa, sputtering pressure: $6.7\times10^{-1}$ Pa, argon flow rate: 20 sccm, no heating and no cooling of substrate, no bias, sputtering power source: RF, sputtering power: 0.5 kW, pre-sputtering time: 5 minutes, sputtering time: 5 minutes, no reactive sputtering, no reverse sputtering, target: $SiO_2$.

(Condition 2)

Ultimate pressure: $5\times10^{-4}$ Pa, sputtering pressure: $6.7\times10^{-1}$ Pa, argon flow rate: 20 sccm, no heating and no cooling of substrate, no bias, sputtering power source: RF, sputtering power: 2.0 kW, pre-sputtering time: 5 minutes, sputtering time: 6 minutes, no reactive sputtering, no reverse sputtering, target: ZrO.

The thickness of the thin layer provided by the sputtering was adjusted to a desired value by controlling the sputtering time based on the correlation calibration curve between the sputtering time and the layer thickness obtained by measuring the thickness of each layer through an atomic force microscope (AFM).

3. Production of Lithographic Printing Plate Support

EXAMPLES 2-1 TO 2-3 AND 2-6 TO 2-12 OF THE INVENTION

Using a combination of a substrate and a coating solution shown in Table 4, the coating solution was coated on the substrate by a commercially available wire bar to have a dry porous layer thickness shown in Table 4 and dried at a drying temperature shown in Tale 4 to form a porous layer.

The thickness of the porous layer was adjusted by selecting the wire size of giving a desired layer thickness from commercially available wire bars varied in the wire size from #1.6 (coated amount: about 3 ml/m$^2$) to #28 (coated amount: about 53 ml/m$^2$).

The drying time was set to 120 seconds irrespective of the thickness of the porous layer.

On the porous layer formed above, a coating solution for the pore-sealing layer having the following composition was coated by a commercially available wire bar to have a dry layer thickness shown in Table 4 and dried (at a temperature of 120° C. for 2 minutes) to form a pore-sealing layer, thereby obtaining lithographic printing plate supports of Examples 2-1 to 2-3 and 2-6 to 2-12 of the invention.

(Composition of Coating Solution for Pore-Sealing Layer)

| | |
|---|---|
| #3 Sodium silicate (reagent produced by Kanto Kagaku) as silicate | 10 g |
| ALMATEX E269 (emulsion resin, produced by Mitsui Chemicals, Inc.) as hydrophilic resin | 0.4 g |
| Water | 50 g |

EXAMPLE 2-4 OF THE INVENTION

A porous layer was formed in the same manner as in Example 2-1 of the invention. However, in the drying, the coating solution was dried at a drying temperature of 180° C. for 30 seconds to solidify the surface of the porous layer.

A mechanical surface-roughening treatment (by brush graining method) was applied to the porous layer under the same method and conditions as in Aluminum Substrate AL-2 to roughen the surface of the porous layer.

Thereafter, in order to solidify the inside of the porous layer, drying was performed at a drying temperature of 180° C. for 90 seconds and thereby the formation of the porous layer was completed.

On the porous layer formed, a pore-sealing layer was formed in the same manner as in Example 2-1 of the invention to obtain the lithographic printing plate support of Example 2-4 of the invention.

EXAMPLE 2-5 OF THE INVENTION

A porous layer having a dry thickness of 5.5 μm was formed in the same manner as in Example 2-1 of the invention. However, in the drying, the coating solution was dried at a drying temperature of 180° C. for 60 seconds to solidify the surface of the porous layer.

Thereafter, a transfer roller was prepared in the same manner as the transfer roller used in the production of Aluminum Substrate AL-4 and the transfer was performed on the surface of the porous layer under the conditions of linear pressing force: 100 g/mm and number of transfers: one time. The area percentage of the recessed portion formed by the transfer was 40%.

On the porous layer formed, a pore-sealing layer was formed in the same manner as in Example 2-1 of the invention to obtain the lithographic printing plate support of Example 2-5 of the invention.

COMPARATIVE EXAMPLE 2-1

An anodic oxide film was formed on Aluminum Substrate AL-2 by the following method to obtain the lithographic printing plate support of Comparative Example 2-1.

That is, an aqueous sulfuric acid solution having a sulfuric acid concentration of 15 wt % (containing 0.5 wt % of aluminum ion) at a temperature of 38° C. was used as the electrolytic solution and a continuous d.c. electrolysis was performed to have a final oxide film amount of 5.5 μm.

COMPARATIVE EXAMPLE 2-2

On the anodic oxide film of the lithographic printing plate support obtained in Comparative Example 2-1, a pore-sealing layer was formed in the same manner as in Example 2-1 of the invention to obtain the lithographic printing plate support of Comparative Example 2-2.

COMPARATIVE EXAMPLE 2-3

An anodic oxide film was formed on Aluminum Substrate AL-2 in the same manner as in Comparative Example 2-1 except for performing the continuous d.c. electrolysis to have an anodic oxide film thickness of 0.8 μm. On the anodic oxide film formed, a pore-sealing layer was formed in the same manner as in Example 2-1 of the invention to obtain the lithographic printing plate support of comparative example 2-3.

In Comparative Examples 2-1 to 2-3, a coating solution was not used for the formation of the anodic oxide film and therefore, the columns of "Coating Solution" and "Drying Temperature" in Table 4 are shown by "-". Also, the thickness of the anodic oxide film is shown in the column of "Thickness of Porous Layer" in Table 4. The porosity of the anodic oxide film was not measured and shown by "-" in the column of "Porosity of Porous Layer".

The thickness of the anodic oxide film was measured by a commonly employed method.

COMPARATIVE EXAMPLE 2-4

On the mirror surface of Aluminum Substrate AL-5, a porous layer was formed in the same manner as in Example 2-1 of the invention and subsequently a pore-sealing layer was formed to obtain the lithographic printing plate support of Comparative Example 2-4.

4. Measurement of Porosity of Porous Layer

The porosity of the porous layer was determined from the thickness of the porous layer shown in Table 4 and the weight of the porous layer after drying.

Specifically, the density was calculated from the thickness of the porous layer and the weight of the film per unit area according to the following formula:

$$\text{Density } (g/cm^3) = (\text{weight of film per unit area/layer thickness})$$

Using the calculated density, the porosity was determined according to the following formula:

$$\text{Porosity } (\%) = \{1-(\text{density of porous layer}/D)\} \times 100$$

wherein D is a density ($g/cm^2$) of the metal oxide used for the formation of the porous layer, which is known in *Kagaku Binran* (*Handbook of Chemistry*).

The weight of the film per unit area of the porous layer was determined by a method commonly known as the Maison method. The thickness of the porous layer shown in Table 4 is a value measured by the observation through an ultrahigh-resolution scanning electron microscope at the following magnification depending on the layer thickness.

The magnification was 10,000 times when the layer thickness was 1 μm or less, the magnification was 3,000 times when the layer thickness was from 1 to 5 μm, and the magnification was from 100 to 3,000 times when the layer thickness was 5 μm or more.

5. Measurement of Surface Roughness Ra of Lithographic Printing Plate Support

The lithographic printing plate supports obtained in Examples 2-1 to 2-12 of the invention and Comparative Examples 2-1 to 2-4 each was subjected to a two-dimensional roughness measurement by a stylus-type roughness meter (Sufcom 575, manufactured by Tokyo Seimitsu Co., Ltd.) and the average roughness Ra specified in IS04287 was measured 5 times. The average thereof was defined as the average roughness. The results are shown in Table 4.

The conditions in the two-dimensional roughness measurement are shown below.

<Measurement Conditions>

Cut-off value: 0.8 mm, inclination correction: FLAT-ML, measured length: 3 mm, longitudinal magnification: 10,000 times, scanning speed: 0.3 mm/sec, tip diameter of stylus: 2 μm.

6. Production of Lithographic Printing Plate Precursor

On each of the lithographic printing plate supports obtained in Examples 2-1 to 2-12 of the invention and Comparative Examples 2-1 to 2-4, a photosensitive coating solution having the following composition was coated to have a dry film amount of 1.0 $g/m^2$ and then dried at 140° C. for 50 seconds in PERFECT OVEN PH200 manufactured by TABAI by setting Wind Control to 7.

(Composition of Photosensitive Coating Solution)

| | |
|---|---|
| m,p-Cresol novolak (m/p ratio = 6/4, weight average molecular weight: 3,500, containing 0.5 wt % of unreacted cresol) | 0.427 g |
| Siloxane Structure-Containing Alkali-Soluble Resin (F-1) obtained by synthesis method shown below | 0.047 g |
| Specific Copolymer 1 described in JP-A-11-288093 | 2.37 g |
| Cyanine Dye A shown below | 0.155 g |
| 2-Methoxy-4-(N-phenylamino) benzene | 0.03 g |
| Diazonium hexafluorophosphate tetrahydrophthalic anhydride | 0.19 g |
| Compound where counter ion of Ethyl Violet was changed to 6-hydroxy-Beta-naphthalenesulfonate | 0.05 g |
| Fluorine-containing surfactant (Megafac F-176PF, produced by Dainippon Ink & Chemicals, Inc.) | 0.035 g |
| Fluorine-containing surfactant (Megafac MCF-312, produced by Dainippon Ink & Chemicals, Inc.) | 0.05 g |
| p-Toluenesulfonic acid | 0.008 g |
| Bis-p-hydroxyphenylsulfone | 0.063 g |
| n-Dodecyl stearate | 0.06 g |
| γ-Butyrolactone | 13 g |
| Methyl ethyl ketone | 24 g |
| 1-Methoxy-2-propanol | 11 g |

(Synthesis of Siloxane Structure-Containing Alkali-Soluble Resin (F-1))

In 400 mL of methanol, 120 g of cresol novolak (m/p ratio=6/4, weight average molecular weight=5,200) was dissolved and thereto, 5.4 g of sodium methoxide was added. The resulting solution was stirred for 30 minutes and after distilling out the methanol under reduced pressure, 400 mL of tetrahydrofuran was added to displace the solvent. Thereto, 17 g of epoxy-type terminal reactive silicone MCR-E11 (produced by Chisso Corporation) was added and the solution was refluxed under heat for 6 hours. The reaction solution was cooled to room temperature and poured into 8,000 mL of water and the separated matter was collected by filtration, washed with water and dried to obtain 132 g of Siloxane Structure-Containing Alkali-Soluble Resin (F-1).

Cyanine Dye A:

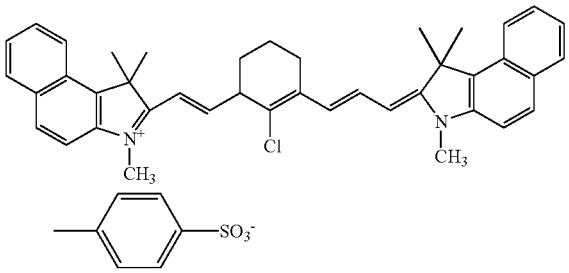

7. Evaluation of Lithographic Printing Plate Precursor and Lithographic Printing Plate <Measurement of Clear Sensitivity>

The lithographic printing plate precursors obtained above each was exposed by using Trend Setter 3244VFS manufactured by Creo Co. equipped with a water-cooled 40 W infrared semiconductor laser and outputting it under the condition of a resolution of 2,400 dpi. At this time, the plate surface energy was varied by changing the rotation number of the outer drum for the evaluation of sensitivity.

After the image exposure, the lithographic printing plate precursors were developed by using PS Processor 900H manufactured by Fuji Photo Film Co., Ltd. having charged therein Developer DT-1 (diluted at 1:8) produced by Fuji Photo Film Co., Ltd. and Finisher FP2W (diluted at 1:1) produced by Fuji Photo Film Co., Ltd., at a liquid temperature of 30° C. for a development time of 12 seconds (the electrical conductivity of the developer was 45 mS/cm).

The sensitivity was evaluated by the minimum exposure amount when scumming or coloration ascribable to the remaining of the image recording layer due to development failure was not observed and satisfactory development was attained, and the exposure amount is shown in Table 2.

The smaller exposure amount reveals more excellent sensitivity of the lithographic printing plate precursor.

<Staining Resistance>

The lithographic printing plate precursor obtained above was subjected to imagewise drawing by using Trend Setter manufactured by Creo Co. at a drum rotation speed of 150 rpm and a beam intensity of 10 W.

Using a lithographic printing plate obtained after developing the lithographic printing plate precursor in the same manner as in the evaluation of the clear sensitivity, printing was performed with an ink of DIC-GEOS(s) Rouge in Mitsubishi Dia Model F2 Press (manufactured by Mitsubishi Heavy Industries, Ltd.). After printing 50 sheets, the press was once stopped and the ink in the blanket portion of the press was transferred to a PET tape produced by Nitto Denko Corporation. The staining with ink in the non-image area on the PET tape was visually evaluated according to the following criteria. The results are shown in Table 4.

The evaluation was performed by 5-stage rating of A, B, C, D and E in the order from the sample where the generation of staining was not confirmed at all.

<Press Life>

Using the lithographic printing plate obtained in the same manner as in the evaluation of <Staining Resistance>, the number of sheets of giving a printed matter free of residual color, residual layer and staining was counted under the same printing conditions. That is, the printing was finished when any one of residual color, residual layer and staining became lower than the allowable level as the printed matter, and the number of sheets at that time was designated as the number of printed sheets. The results are shown in Table 4.

The evaluation was performed by 5-stage rating of A, B, C, D and E in the order from the sample where the number of printed sheets is large.

<Shiny Property>

The lithographic printing plate obtained in the same manner as in the evaluation of <Staining Resistance> was mounted on a Lithron press (manufactured by Komori Corporation and while increasing the amount supplied of the fountain solution, the shining state of the non-image area on the plate surface was visually observed. The shiny property (suitability for plate inspection, that is, visibility of the amount of fountain solution on the plate surface) was evaluated by the amount supplied of the fountain solution when the non-image area started to shine. The results are shown in Table 4.

The evaluation was performed by 6-stage rating of AA, A, B, C, D and E in the order from the sample where the amount of the fountain solution is large when the non-image area started to shine to the sample where the amount of the fountain solution is small.

TABLE 4

| | Substrate | Coating Solution | Drying Temperature (° C.) | Thickness of Porous Layer (μm) | Porosity of Porous Layer (%) | Thickness of Pore-Sealing Layer (μm) | Surface Roughness Ra (μm) | Sensitivity (mJ/cm$^{2)}$ | Staining Resistance | Press Life | Shiny Property |
|---|---|---|---|---|---|---|---|---|---|---|---|
| Example 2-1 | AL-2 | C-1 | 180 | 0.8 | 50 | 0.2 | 0.3 | 350 | A | A | A |
| Example 2-2 | AL-3 | C-1 | 180 | 0.8 | 50 | 0.2 | 0.6 | 350 | A | A | AA |
| Example 2-3 | AL-4 | C-1 | 180 | 5.5 | 50 | 0.2 | 2.0 | 220 | C | A | AA |
| Example 2-4 | AL-1 | C-1 | 180 | 0.8 | 50 | 0.2 | 1.0 | 350 | B | A | AA |

TABLE 4-continued

| | Substrate | Coating Solution | Drying Temperature (° C.) | Thickness of Porous Layer (μm) | Porosity of Porous Layer (%) | Thickness of Pore-Sealing Layer (μm) | Surface Roughness Ra (μm) | Sensitivity (mJ/cm$^2$) | Staining Resistance | Press Life | Shiny Property |
|---|---|---|---|---|---|---|---|---|---|---|---|
| Example 2-5 | AL-1 | C-1 | 180 | 5.5 | 50 | 0.2 | 2.0 | 220 | C | A | AA |
| Example 2-6 | AL-2 | C-2 | 200 | 0.8 | 40 | 0.2 | 0.3 | 370 | A | A | A |
| Example 2-7 | SUS-1 | C-3 | 300 | 0.8 | 30 | 0.2 | 0.3 | 390 | A | A | A |
| Example 2-8 | SUS-2 | C-4 | 260 | 0.8 | 50 | 0.2 | 0.3 | 350 | A | A | A |
| Example 2-9 | AL-2 | C-5 | 200 | 0.8 | 30 | 0.2 | 0.3 | 370 | A | A | A |
| Example 2-10 | AL-2 | C-6 | 200 | 0.8 | 30 | 0.2 | 0.3 | 390 | A | A | A |
| Example 2-11 | AL-2 | C-7 | 200 | 0.8 | 50 | 0.2 | 0.3 | 350 | A | A | A |
| Example 2-12 | AL-2 | C-8 | 200 | 0.8 | 30 | 0.2 | 0.3 | 390 | A | C | C |
| Comparative Example 2-1 | AL-2 | — | — | 5.5 | — | 0 | 0.5 | 480 | E | A | A |
| Comparative Example 2-2 | AL-2 | — | — | 5.5 | — | 0.2 | 0.5 | 420 | A | A | A |
| Comparative Example 2-3 | AL-2 | — | — | 0.8 | — | 0.2 | 0.5 | 550 | A | A | A |
| Comparative Example 2-4 | AL-5 | C-1 | 180 | 0.8 | 50 | 0.2 | 0.2 | 350 | A | D | D |

As apparent from Table 4, when the lithographic printing plate support where a porous layer comprising metal oxide particles bound by a compound containing a metal atom and a phosphorus atom is provided has a surface roughness in the range of the present invention, the high heat insulating property (sensitivity), excellent press life and superior staining resistance of the porous layer are not impaired and furthermore, the press life and the shiny property are improved to a higher level.

The porous layer can be formed at a relatively low temperature (less than the temperature of causing softening of aluminum) and therefore, even when an aluminum substrate is used as the substrate, the printing performance is prevented from reduction (particularly, misregistering between the substrate and the image) due to softening of the aluminum substrate.

In addition, the lithographic printing plate support of the present invention where the porous layer is provided is not impaired in the high heat insulating property (sensitivity), excellent press life and superior staining resistance and can be improved in the press life and shiny property to a higher level even when produced by using various substrates.

On the other hand, in Comparative Examples 2-1 to 2-3, particularly the sensitivity is poor and in Comparative Example 2-4, particularly the shiny property is poor. Thus, the lithographic printing pate supports of Comparative Examples 2-1 to 2-4 are poor in any one of the sensitivity, press life, staining resistance and shiny property.

EXAMPLE 3

EXAMPLES 3-1 to 3-15 OF THE INVENTION LITHOGRAPHIC PRINTING PLATE SUPPORT

Lithographic printing plate supports were produced by coating a coating solution for interlayer having a composition shown in Table 5 below by means of a commercially available wire bar (wire size: 0.25 mm) on each of the following substrates (1) to (4) with an aluminum surface, and drying the coating solution to have a dry thickness shown in Table 5, thereby forming an interlayer. The porosity and thickness of each of the interlayers formed are shown in Table 5.

(Substrate with Aluminum Surface)

(1) A 0.24 mm-thick aluminum plate subjected to alkali degreasing (indicated as aluminum in Table 5).

(2) Aluminum-laminated paper (obtained by using wood-free paper (thickness: 180 μm) produced by Oji Paper Co., Ltd., multi-use bond (adhesive layer: 50 μm) produced by Konishi Co., Ltd. Incorporated, aluminum foil (thickness: 10 μm) produced by Sumitomo Light Metal Industries, Ltd., and laminator DX-700 manufactured by TOLAMI; indicated as Al/paper in Table 5).

(3) Aluminum-laminated polyethylene terephthalate (PEG) film (obtained by using PET (thickness: 220 μm), produced by Toray Industries, Inc., 3000DXF (adhesive layer: 10 μm) produced by CEMEDINE Co., Ltd., aluminum foil (thickness: 10 μm) produced by Sumitomo Light Metal Industries, Ltd., and laminator DX-700 manufactured by TOLAMI; indicated as Al/PET in Table 5).

(4) Aluminum-deposited steel sheet (obtained by vapor depositing 99.9% aluminum as the uppermost layer to a thickness of 0.1 μm on an iron sheet (thickness: 240 μm) produced by Kobe Steel Ltd. under condition of a vacuum degree of $10^{-6}$ Torr and a substrate temperature of 250° C.; indicated as Al/steel sheet in Table 5).

COMPARATIVE EXAMPLE 3-1

An interlayer was provided on the same substrate as in Example 3-1 of the invention by using a coating solution not containing a high-porosity particle, shown in Table 5, to obtain the lithographic printing plate support of Comparative Example 3-1.

COMPARATIVE EXAMPLE 3-2

An anodization treatment was applied to the same substrate as in Example 3-1 of the invention to provide a 1.0 μm-thick anodic oxide film and the substrate was dipped in an aqueous sodium hydroxide solution at a pH of 13 to enlarge micropores in the anodic oxide film, thereby increasing the porosity, to produce the lithographic printing plate support of Comparative Example 3-2.

COMPARATIVE EXAMPLE 3-3

A 1.0 μm-thick anodic oxide film was provided by applying an anodization treatment to the same substrate as in Example 3-1 of the invention to produce the lithographic printing plate support of Comparative Example 3-3.

COMPARATIVE EXAMPLE 3-4

A polyethylene terephthalate (PET) film (PET (thickness: 220 μm), produced by Toray Industries, Inc.) was used as the lithographic printing plate support of Comparative Example 3-4.

The heat insulating property and scratch resistance shown in Table 5 were evaluated as follows.

(Measuring Method of Heat Insulating Property)

A. Vapor Deposition of Titanium

A metal titanium wire of 0.5 mmϕ×20 mm (produced by Nilaco Corporation) was evaporated under heating for about 20 seconds by using a vacuum deposition apparatus (JEE-4X, manufactured by JEOL) at a vacuum degree of $4.5\times10^{-6}$ Torr with a current of 40 A and then deposited on a sample.

TABLE 5

| | | Alumina | | | High-Porosity Particle | | |
|---|---|---|---|---|---|---|---|
| | Substrate | Kind | Particle Size (μm) | Content (g) | Species | Kind (solid content, %) | Content (g) |
| Example | | | | | | | |
| 3-1 | aluminum | AKP-30 | 0.3 | 22.2 | hollow particle | JSR/SX866A | 7.2 |
| 3-2 | aluminum | AKP-30 | 0.3 | 22.2 | hollow particle | JSR/SX866A | 7.2 |
| 3-3 | aluminum | AKP-30 | 0.3 | 22.2 | hollow particle | JSR/SX866A | 7.2 |
| 3-4 | aluminum | AKP-30 | 0.3 | 22.2 | hollow particle | JSR/SX866B (porosity: 30%) (20%) | 36 |
| 3-5 | aluminum | AKP-30 | 0.3 | 22.2 | hollow particle | JSR/SX452A (porosity: 30%) (28.8%) | 28.8 |
| 3-6 | aluminum | AKP-G015 | 0.1 | 22.2 | hollow particle | JSR/SX866A | 7.2 |
| 3-7 | aluminum | AKP-30 | 0.3 | 22.2 | porous particle | Nippon Aerosil/Aluminum Oxide C | 7.2 |
| 3-8 | aluminum | AKP-30 | 0.3 | 22.2 | porous particle | Shinagawa Fire Brick/Porous Alumina A99M | 7.2 |
| 3-9 | aluminum | AKP-30 | 0.3 | 22.2 | porous particle | RACE/Porous Silica SXLOJETP405 (20%) | 36 |
| 3-10 | aluminum | AKP-30 | 0.3 | 22.2 | anisotropic particle | Shokubai Kasei/FINE CATAROID F-120 (20%) | 36 |
| 3-11 | aluminum | AKP-30 | 0.3 | 22.2 | anisotropic particle | Nissan Chemical/Snowtex UP (20%) | 36 |
| 3-12 | aluminum | AKP-30 | 0.3 | 22.2 | anisotropic particle | Nissan Chemical/Snowtex PS-M (20%) | 36 |
| 3-13 | Al/paper | Nanotec Alumina | 0.033 | 22.2 | hollow particle | JSR/SX866A | 7.2 |
| 3-14 | Al/PET | Nanotec Alumina | 0.033 | 22.2 | hollow particle | JSR/SX866A | 7.2 |
| 3-15 | Al/steel sheet | Nanotec Alumina | 0.033 | 22.2 | hollow particle | JSR/SX866A | 7.2 |
| Comparative Example | | | | | | | |
| 3-1 | aluminum | AKP-30 | 0.3 | 44.4 | | none | |
| 3-2 | aluminum | | | | | none | |
| 3-3 | aluminum | | | | | none | |
| 3-4 | PET | | | | | none | |

| | Citric Acid (g) | Phosphoric Acid (g) | Aluminum Chloride (g) | Water (g) | Porosity (%) | Thickness of Interlayer (μm) | Heat Insulating Property | Scratch Resistance |
|---|---|---|---|---|---|---|---|---|
| Example | | | | | | | | |
| 3-1 | 0.1 | 2.6 | 8 | 67 | 65 | 4 | A | A |
| 3-2 | 0.1 | 2.6 | 8 | 167 | 65 | 2 | A | B |
| 3-3 | 0.1 | 2.6 | 8 | 267 | 65 | 1 | A | B |
| 3-4 | 0.1 | 2.6 | 8 | 29 | 65 | 4 | A | A |
| 3-5 | 0.1 | 2.6 | 8 | 38 | 65 | 4 | A | A |
| 3-6 | 0.1 | 2.6 | 8 | 67 | 60 | 4 | A | A |
| 3-7 | 0.1 | 2.6 | 8 | 67 | 50 | 4 | A | A |
| 3-8 | 0.1 | 2.6 | 8 | 67 | 68 | 4 | A | A |
| 3-9 | 0.1 | 2.6 | 8 | 29 | 65 | 4 | A | A |
| 3-10 | 0.1 | 2.6 | 8 | 29 | 62 | 4 | A | A |
| 3-11 | 0.1 | 2.6 | 8 | 29 | 62 | 4 | A | A |
| 3-12 | 0.1 | 2.6 | 8 | 29 | 62 | 4 | A | A |
| 3-13 | 0.1 | 2.6 | 8 | 67 | 60 | 4 | A | B |
| 3-14 | 0.1 | 2.6 | 8 | 67 | 60 | 4 | A | B |
| 3-15 | 0.1 | 2.6 | 8 | 67 | 60 | 4 | A | A |
| Comparative Example | | | | | | | | |
| 3-1 | 0.1 | 2.6 | 8 | 67 | 45 | 4 | B | A |
| 3-2 | | | | | 40 | 1 | D | B |
| 3-3 | | | | | 14 | 1 | E | B |
| 3-4 | | | | | 0 | 1 | A | E |

B. Exposure

Thereafter, the sample was exposed by a YAG laser exposure apparatus (disk rotation type) manufactured by the applicant at 0.724 W (plate surface energy: 4.8 J/cm$^2$, corresponding to a sensitivity of 1,000 mJ/cm$^2$ of the light-sensitive material) and the exposure line width was measured by an optical microscope.

Specification of Laser (name of apparatus: DPY321II, manufactured by ADLAS):

Gauss-type beam profile laser

Beam diameter (1/e$^2$): 35 μm, scanning speed: 1.2 m/s

In the sample obtained by vapor-depositing Ti on a commercially available PET base, the line width was 50 μm. With the samples, a 5-stage relative evaluation was performed as follows. The results are shown in Table 5.

Evaluation of Heat Insulating Property:

A: line width of 45 to 55 μm

B: line width of 35 to 44 μm

C: line width of 25 to 34 μm

D: line width of 15 to 24 μm

E: line width of less than 15 μm (Measuring Method of Scratch Resistance)

A scratch test was performed by using a continuous load applying scratch tester TYPE18 manufactured by Shinto Scientific Co., Ltd. under the following conditions.

Needle: sapphire of 0.4 mmϕ

Scratching rate: 10 cm/sec

Applied load: 30 g

The scratch portion was observed by SEM and the evaluation was performed by the following 4-stage rating according to the scratch state. The results are shown in Table 5.

Evaluation of Scratch Resistance:

A: Absolutely no scratch.

B: Scratch was slightly observed on the surface.

C: Scratch was clearly observed.

E: Scratch reached the substrate surface.

EXAMPLES 3-16 TO 3-30 OF THE INVENTION AND COMPARATIVE EXAMPLES 3-5 TO 3-8 HEAT-SENSITIVE LITHOGRAPHIC PRINTING PLATE (1) Formation of Hydrophilic Layer On the interlayer of each lithographic printing plate support produced in Examples 3-1 to 3-15 of the invention and on each support of Comparative Examples 3-1 to 3-4, a coating solution for hydrophilic layer having the following composition was coated to have a dry thickness of 0.10 μm by a commercially available wire bar (wire size: 0.25 mm) and then dried to form a hydrophilic layer.

(Coating Solution for Hydrophilic Layer)

| | |
|---|---|
| Metal oxide fine particle (Nanotec Alumina, produced by C. I. Kasei Co., Ltd., product name: ultrafine particle, average particle size: 33 nm) | 18.5 g |
| #3 Sodium silicate | 19.8 g |
| Acryl emulsion, ALMATEX E269 (produced by Mitsui Chemicals, Inc.) | 0.8 g |
| Water | 1,400 g |

(2) Formation of Heat-Sensitive Layer (2-1) Preparation of Microcapsule

Xylylene diisocyanate (40 g), 10 g of trimethylolpropane diacrylate, 10 g of an allyl methacrylate-butyl methacrylate copolymer (molar ratio: 7/3) and 0.1 g of a surfactant (PIONIN A41C, produced by Takemoto Oil. & Fat Co., Ltd.) were dissolved in 60 g of ethyl acetate and the solution was used as the oil phase component. Separately, 120 g of a 4% aqueous solution of polyvinyl alcohol (PVA205, produced by Kuraray Co., Ltd.) was prepared and used as the aqueous phase component. The oil phase component and the aqueous phase component were charged into a homogenizer and emulsified at 10,000 rpm. Thereto, 40 g of water was added and stirred at room temperature for 30 minutes and further at 40° C. for 3 hours to obtain a microcapsule solution. The solid concentration of the obtained microcapsule solution was 20 wt % and the average particle size of microcapsules was 0.2 μm.

(2-2) Coating of Heat-Sensitive Layer

On the hydrophilic layer formed above of the support, a coating solution for heat-sensitive layer was coated and dried in an oven at 60° C. for 150 seconds to obtain a heat-sensitive printing plate. The dry coated amount of the heat-sensitive layer was 0.7 g/m$^2$.

<Composition of Coating Solution for Heat-Sensitive Layer>

| | |
|---|---|
| Microcapsule solution synthesized above (in terms of polymer solid content) | 5 g |
| Trimethylolpropane triacrylate | 3 g |
| Light-to-heat converting agent (Cyanine Dye A shown below) | 0.3 g |
| Water | 60 g |
| 1-Methoxy-2-propanol | 40 g |

Cyanine Dye A:

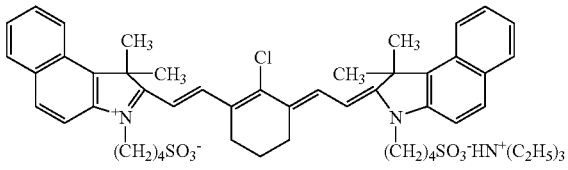

The thus-obtained heat-sensitive lithographic printing plate was evaluated on the properties as follows.

(Evaluation of Sensitivity)

The lithographic printing plate obtained above was exposed by using Trend Setter 3244VFS manufactured by Creo Co. equipped with a water-cooled 40 W infrared semiconductor laser and outputting it under the condition of a resolution of 2,400 dpi. At this time, the plate surface energy was varied by changing the rotation number of the outer drum. The exposed plate was mounted as it was to a press and developed on the press by supplying a fountain solution and an ink. The minimum exposure amount capable of forming an image was determined and the sensitivity was evaluated by the obtained value. The results are shown in Table 6 below.

<Evaluation of Staining Resistance>

The press was once stopped and the ink in the blanket portion of the press was transferred to a PET tape produced by Nitto Denko Corporation. The staining with ink in the non-image area on the PET tape was visually evaluated according to the following criteria. The results are shown in Table 6 below.

Staining Resistance:

A: The generation of staining was not visually observed at all.

B: The generation of staining was scarcely observed visually.

C: The generation of staining was visually observed.

D: Staining was seriously generated.

E: Staining was generated throughout the non-image area.

<Press Life>

The number of sheets of giving a printed matter free of residual color, residual layer and staining was counted under the same conditions as above. That is, the printing was finished when any one of residual color, residual layer and staining became lower than the allowable level as the printed matter, and according to the number of sheets at that time (number of printed sheets), the press life was evaluated as follows. The results are shown in Table 6 below.

Press Life:

A: 10,000 or more printed sheets

B: 3,000 to 9,999 printed sheets

C: less than 3,000 printed sheets

TABLE 6

| | Support | Sensitivity ($mJ/cm^2$) | Staining Resistance | Press Life |
|---|---|---|---|---|
| Example | | | | |
| 3-16 | 1 | 150 | A | A |
| 3-17 | 2 | 150 | A | A |
| 3-18 | 3 | 150 | A | A |
| 3-19 | 4 | 150 | A | A |
| 3-20 | 5 | 150 | A | A |
| 3-21 | 6 | 200 | A | A |
| 3-22 | 7 | 220 | A | A |
| 3-23 | 8 | 225 | A | A |
| 3-24 | 9 | 150 | A | A |
| 3-25 | 10 | 180 | A | A |
| 3-26 | 11 | 180 | A | A |
| 3-27 | 12 | 200 | A | A |
| 3-28 | 13 | 200 | A | A |
| 3-29 | 14 | 200 | A | A |
| 3-30 | 15 | 250 | A | A |
| Comparative Example | | | | |
| 3-5 | 1 | 260 | A | A |
| 3-6 | 2 | 280 | A | A |
| 3-7 | 3 | 300 | A | A |
| 3-8 | 4 | 150 | A | C |

From the results shown above, it can be seen that the lithographic printing plates according to the invention exhibit high sensitivity without accompanying degradation of the staining resistance and press life in comparison with the lithographic printing plates for comparison.

EXAMPLES 3-31 TO 3-45 OF THE INVENTION AND COMPARATIVE EXAMPLES 3-9 TO 3-12

On each of the supports obtained in Examples 3-1 to 3-15 of the invention and Comparative Examples 3-1 to 3-4, a hydrophilic layer was provided in the same manner as in Examples 3-16 to 3-30 of the invention and Comparative Examples 3-5 to 3-8. On the hydrophilic layer, the following Coating Solution 1 for positive heat-sensitive layer was coated to have a dry coated amount of 1.0 $g/m^2$ and then dried at 140° C. for 50 seconds in PERFECT OVEN PH200 manufactured by TABAI by setting Wind Control to 7 to obtain a heat-sensitive lithographic printing plate.

(Coating Solution 1)

| | |
|---|---|
| m,p-Cresol novolak (m/p ratio = 6/4, weight average molecular weight: 3,500, containing 0.5 wt % of unreacted cresol) | 0.427 g |
| Siloxane Structure-Containing Alkali-Soluble Resin (F-1) obtained by synthesis method shown below | 0.047 g |
| Specific Copolymer 1 described in JP-A-11-288093 | 2.37 g |
| Light-to-heat converting agent (Cyanine Dye B shown below) | 0.155 g |
| 2-Methoxy-4-(N-phenylamino) benzene | 0.03 g |
| Diazonium hexafluorophosphate tetrahydrophthalic anhydride | 0.19 g |
| Compound where counter ion of Ethyl Violet was changed to 6-hydroxy-β-naphthalenesulfonate | 0.05 g |
| Fluorine-containing surfactant (Megafac F-176PF, produced by Dainippon Ink & Chemicals, Inc.) | 0.035 g |
| Fluorine-containing surfactant (Megafac MCF-312, produced by Dainippon Ink & Chemicals, Inc.) | 0.05 g |
| p-Toluenesulfonic acid | 0.008 g |
| Bis-p-hydroxyphenylsulfone | 0.063 g |
| n-Dodecyl stearate | 0.06 g |
| γ-Butyrolactone | 13 g |
| Methyl ethyl ketone | 24 g |
| 1-Methoxy-2-propanol | 11 g |

(Synthesis of Siloxane Structure-Containing Alkali-Soluble Resin (F-1))

In 400 ml of methanol, 120 g of cresol novolak (m/p ratio=6/4, Mw=$5.2\times10^3$) was dissolved and thereto, 5.4 g of sodium methoxide was added. The resulting solution was stirred for 30 minutes and after distilling out the methanol under reduced pressure, 400 ml of tetrahydrofuran was added to displace the solvent. Thereto, 17 g of epoxy-type terminal reactive silicone MCR-E11 (produced by Chisso Corporation) was added and the solution was refluxed under heat for 6 hours. The reaction solution was cooled to room temperature and poured into 8,000 ml of water and the separated matter was collected by filtration, washed with water and dried to obtain 132 g of Siloxane Structure-Containing Alkali-Soluble Resin (F-1).

Cyanine Dye B:

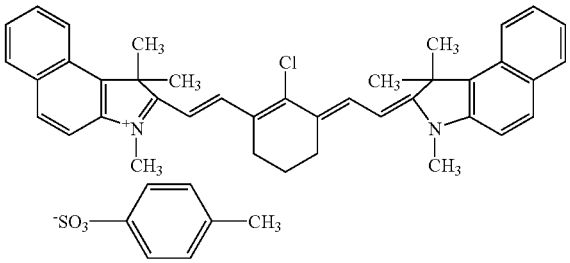

The thus-produced heat-sensitive positive lithographic printing plates were evaluated on the sensitivity, staining resistance and press life in the same manner as in Example 3-16 of the invention. In place of the on-press development in Example 3-16 of the invention, the heat-sensitive positive lithographic printing plates were developed by using PS Processor 900H manufactured by Fuji Photo Film Co., Ltd. having charged therein Developer DT-1 (diluted at 1:8) produced by Fuji Photo Film Co., Ltd. and Finisher FP2W (diluted at 1:1) produced by Fuji Photo Film Co., Ltd., at a liquid temperature of 30° C. for a development time of 12 seconds (the electrical conductivity of the developer was 45 mS/cm).

The evaluation results are shown in Table 7 below.

TABLE 7

| | Support | Sensitivity (mJ/cm$^2$) | Staining Resistance | Press Life |
|---|---|---|---|---|
| Example | | | | |
| 3-31 | 1 | 75 | A | A |
| 3-32 | 2 | 75 | A | A |
| 3-33 | 3 | 75 | A | A |
| 3-34 | 4 | 75 | A | A |
| 3-35 | 5 | 75 | A | A |
| 3-36 | 6 | 100 | A | A |
| 3-37 | 7 | 110 | A | A |
| 3-38 | 8 | 112.5 | A | A |
| 3-39 | 9 | 125 | A | A |
| 3-40 | 10 | 90 | A | A |
| 3-41 | 11 | 90 | A | A |
| 3-42 | 12 | 100 | A | A |
| 3-43 | 13 | 100 | A | A |
| 3-44 | 14 | 100 | A | A |
| 3-45 | 15 | 125 | A | A |
| Comparative Example | | | | |
| 3-9 | 1 | 130 | A | A |
| 3-10 | 2 | 140 | A | A |
| 3-11 | 3 | 150 | A | A |
| 3-12 | 4 | 75 | A | C |

From the results shown above, it can be seen that the lithographic printing plates according to the invention exhibit high sensitivity without accompanying degradation of the staining resistance and press life in comparison with the lithographic printing plates for comparison.

The entire disclosure of each and every foreign patent application from which the benefit of foreign priority has been claimed in the present application is incorporated herein by reference, as if fully set forth herein.

While the invention has been described in detail and with reference to specific embodiments thereof, it will be apparent to one skilled in the art that various changes and modifications can be made therein without departing from the spirit and scope thereof.

What is claimed is:

1. A lithographic printing plate support comprising a non-anodized substrate having thereon a porous layer comprising metal oxide particles bound by a reaction product between a phosphorus compound and a metal oxide, or a reaction product between a phosphorus compound and a reaction accelerator, wherein the substrate is an aluminum plate, an aluminum-laminated paper, an aluminum-laminated resin or an aluminum-coated metal.

2. The lithographic printing plate support as claimed in claim 1, wherein the metal oxide is an oxide or composite oxide of at least one metal selected from the group consisting of silicon, magnesium, zirconium and titanium.

3. The lithographic printing plate support as claimed in claim 1, wherein a thickness of the porous layer is from 0.5 to 20 μm and a surface roughness Ra of the support is from 0.3 to 2.0 μm.

4. The lithographic printing plate support as claimed in claim 1, wherein a pore-sealing layer is further provided on the porous layer.

5. The lithographic printing plate support as claimed in claim 4, wherein a thickness of the porous layer is from 0.5 to 20 μm, a thickness of the pore-sealing layer is from 0.01 to 0.5 μm and a surface roughness Ra of the support is from 0.3 to 2.0 μm.

6. A lithographic printing plate support comprising a non-anodized substrate having thereon an interlayer formed from a composition comprising high-porosity particles incorporated in a reaction product between an alumina particle, a phosphoric acid and an aluminum compound.

7. The lithographic printing plate support as claimed in claim 6, wherein the substrate is an aluminum plate, an aluminum-laminated paper, an aluminum-laminated resin or an aluminum-coated metal.

8. A method for producing a lithographic printing plate support comprising a non-anodized subsisate having thereon a porous layer and a pore-sealing layer in this order, which comprises surface-roughening the substrate, providing the porous layer comprising metal oxide particles bound by a reaction product between a phosphorous compound and a metal oxide, or a reaction product between a phosphorous compound and a reaction accelerator on the surface-roughened substrate, and providing the pore-sealing layer on the porous layer.

* * * * *